US009104166B2

(12) United States Patent
Sato et al.

(10) Patent No.: US 9,104,166 B2
(45) Date of Patent: Aug. 11, 2015

(54) IMAGE FORMING APPARATUS HAVING PHOTOSENSITIVE DRUM AND TRANSFER BELT

(71) Applicant: Brother Kogyo Kabushiki Kaisha, Nagoya-shi, Aichi-ken (JP)

(72) Inventors: Shougo Sato, Seto (JP); Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/656,030

(22) Filed: Mar. 12, 2015

(65) Prior Publication Data

US 2015/0185690 A1 Jul. 2, 2015

Related U.S. Application Data

(63) Continuation of application No. 14/290,532, filed on May 29, 2014, which is a continuation of application No. 13/425,452, filed on Mar. 21, 2012, now Pat. No. 8,744,311.

(30) Foreign Application Priority Data

Jun. 27, 2011 (JP) ..... 2011-141599

(51) Int. Cl.
*G03G 15/01* (2006.01)
*G03G 21/16* (2006.01)
(Continued)

(52) U.S. Cl.
CPC ..... *G03G 15/751* (2013.01); *G03G 21/1633* (2013.01); *G03G 2215/0132* (2013.01); *G03G 2221/1651* (2013.01); *G03G 2221/1684* (2013.01)

(58) Field of Classification Search
CPC ..... G03G 15/751; G03G 15/0189; G03G 21/1633; G03G 15/1842; G03G 15/1864; G03G 2215/0132; G03G 2221/1651; G03G 2221/1684
USPC ..... 399/117, 110, 113
See application file for complete search history.

(56) References Cited

U.S. PATENT DOCUMENTS 8,559,845 B2 10/2013 Okabe et al.
2003/0053819 A1 3/2003 Nomura et al.
(Continued)

FOREIGN PATENT DOCUMENTS

CN 1755555 A 4/2006
CN 102023556 A 4/2011
(Continued)

OTHER PUBLICATIONS

Mar. 10, 2015—(JP) Office Action—App 2011-141599, Eng Tran.
(Continued)

*Primary Examiner* — Sophia S Chen
(74) *Attorney, Agent, or Firm* — Banner & Witcoff, Ltd.

(57) ABSTRACT

In an image forming apparatus, when a photosensitive drum is mounted to the main body, the photosensitive drum is disposed below a positioning member and a transfer belt is disposed above the photosensitive drum. A first urging member urges downward an end of the photosensitive drum that is defined in an axial direction of the first photosensitive drum. A second urging member urges the photosensitive drum when the photosensitive drum is mounted to the main body. The second urging member urges the photosensitive drum upward against an urging force of the first urging member, thereby causing the photosensitive drum to make contact with the positioning member. The first urging member is disposed at a position between the positioning member and the second urging member in the axial direction of the photosensitive drum.

18 Claims, 22 Drawing Sheets

(51) Int. Cl.
*G03G 21/18* (2006.01)
*G03G 15/00* (2006.01)

(56) References Cited

U.S. PATENT DOCUMENTS

| | | | |
|---|---|---|---|
| 2006/0067734 | A1 | 3/2006 | Igarashi et al. |
| 2007/0154235 | A1 | 7/2007 | Saito et al. |
| 2009/0028602 | A1 | 1/2009 | Kamimura et al. |
| 2009/0169267 | A1 | 7/2009 | Sakuma |
| 2010/0080622 | A1 | 4/2010 | Uchida |
| 2010/0080624 | A1 | 4/2010 | Matsuda |
| 2011/0026966 | A1 | 2/2011 | Ushiozu |
| 2011/0064457 | A1 | 3/2011 | Okabe et al. |
| 2011/0305479 | A1 | 12/2011 | Nishiuwatoko et al. |
| 2012/0039624 | A1 | 2/2012 | Uchida et al. |
| 2014/0016964 | A1 | 1/2014 | Okabe et al. |

FOREIGN PATENT DOCUMENTS

| | | | |
|---|---|---|---|
| JP | H04-367870 | A | 12/1992 |
| JP | 2004-109455 | A | 4/2004 |
| JP | 2004-347742 | A | 12/2004 |
| JP | 2006-098776 | A | 4/2006 |

OTHER PUBLICATIONS

Chinese First Office Action mailed Jun. 5, 2014, CN Appln. 201210088855.5, English translation.

IMAGE FORMING APPARATUS HAVING PHOTOSENSITIVE DRUM AND TRANSFER BELT

CROSS REFERENCE TO RELATED APPLICATION

This application is a continuation of U.S. patent application Ser. No. 14/290,532, filed on May 29, 2014, which is a continuation of U.S. patent application Ser. No. 13/425,452, filed on Mar. 21, 2012, now U.S. Pat. No. 8,744,311, which claims priority from Japanese Patent Application No. 2011-141599 filed Jun. 27, 2011. The contents of the above noted applications are incorporated herein by reference in their entirety.

TECHNICAL FIELD

The present invention relates to an image forming apparatus of an electrophotographic type.

BACKGROUND

One electrophotographic type color printer conventionally well known in the art includes four photosensitive drums and four developing rollers. The photosensitive drums are provided in correspondence with colors of yellow, magenta, cyan, and black, respectively. The developing rollers are provided in one to one correspondence with the photosensitive drums and are designed to supply toner to the photosensitive drums.

As one example of such a type of printer, there is known a laser printer that includes an image formation unit frame and a plurality of developing cartridges. The image formation unit frame integrally supports a plurality of photosensitive drums in correspondence with a plurality of colors such that the photosensitive drums are incapable of being detached from the image formation unit frame. The image formation unit frame can be pulled out of the main casing of the laser printer and detached from the main casing. Each developing cartridge is detachably mounted to the image formation unit frame in correspondence with one of the photosensitive drums.

SUMMARY

In the above-described laser printer, however, the image formation unit frame has to be provided with a configuration for detachably mounting the developing cartridges and a configuration for enabling the image formation unit frame to be pulled out of the main casing. This makes it difficult to downsize the frame and to reduce production costs of the frame.

In view of the foregoing, it is an object of the present invention to provide an image forming apparatus, in which a drum supporting member for supporting the photosensitive drums has a small size and can be produced at low cost.

In order to attain the above and other objects, the invention provides an image forming apparatus. The image forming apparatus may include: a main body; a first photosensitive drum detachably mountable to the main body; a transfer belt; a first urging member; and a second urging member. The main body may have a positioning member. The first photosensitive drum may be detachably mountable to the main body. The first photosensitive drum may be disposed below the positioning member when the first photosensitive drum is mounted to the main body. The transfer belt may be disposed above the first photosensitive drum when the first photosensitive drum is mounted to the main body. The first urging member may be configured to urge an end of the first photosensitive drum downward. The end of the first photosensitive drum may be defined in an axial direction of the first photosensitive drum. The second urging member may be configured to urge the first photosensitive drum when the first photosensitive drum is mounted to the main body. The second urging member may be configured to urge the first photosensitive drum upward against an urging force of the first urging member, thereby causing the first photosensitive drum to contact with the positioning member. The first urging member may be disposed at a position between the positioning member and the second urging member in the axial direction of the first photosensitive drum.

BRIEF DESCRIPTION OF THE DRAWINGS

The particular features and advantages of the invention as well as other objects will become apparent from the following description taken in connection with the accompanying drawings, in which:

FIGS. 7-9 illustrate how the process unit is pulled out of the main casing, wherein FIG. 7 shows the state that a front cover is opened and the process unit is pulled out just before a black photosensitive drum contacts a follow roller, FIG. 8 shows the state, following the state of FIG. 7, in which the process unit moves downward and forward in order that the black photosensitive drum does not contact the follow roller, and FIG. 9 shows the state, following the state of FIG. 8, in which the process unit reaches the pulled-out position;

FIGS. 17-19 illustrate how the process unit is pulled out of the main casing in FIG. 11, wherein FIG. 17 shows the state that the process unit is in the mounted position, a front cover is in a closed position, and the photosensitive drums are pressed against the belt unit, FIG. 18 shows the state, following the state of FIG. 17, in which the process unit is in the mounted position, the front cover is in an opened position, and the photosensitive drums are separated away from the belt unit, and FIG. 19 shows the state, following the state of FIG. 18, in which the process unit is pulled out to the pulled-out position;

DETAILED DESCRIPTION

Figure 1:
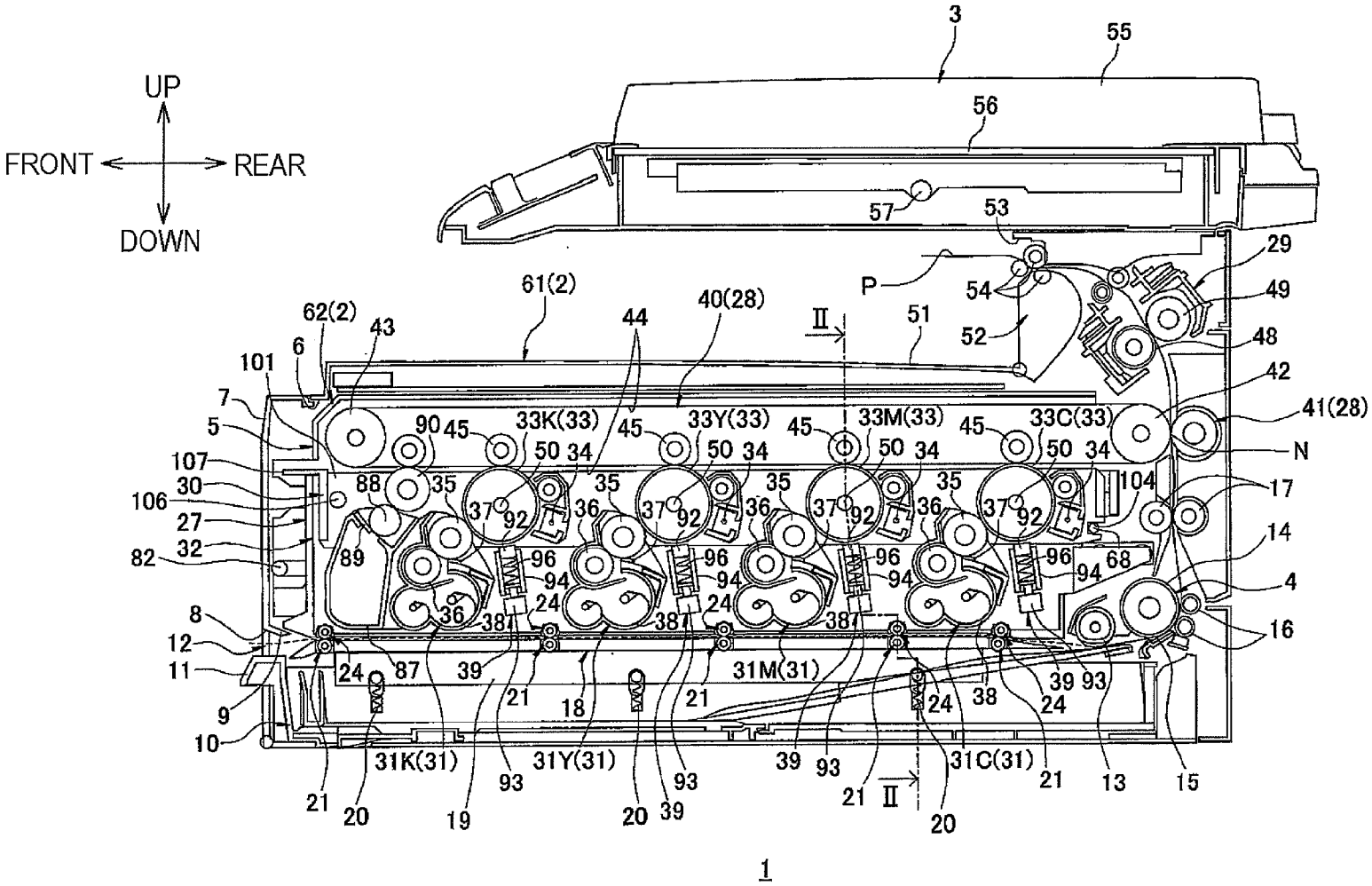
FIG. 1 is a cross-sectional view of a color printer according to a first embodiment of the present invention.

An image forming apparatus according to embodiments of the invention will be described while referring to the accompanying drawings wherein like parts and components are designated by the same reference numerals to avoid duplicating description.

First, an image forming apparatus according to a first embodiment of the present invention will be described while referring to FIGS. 1 to 10.

1. Overall Structure of Color Printer

Figure 2:
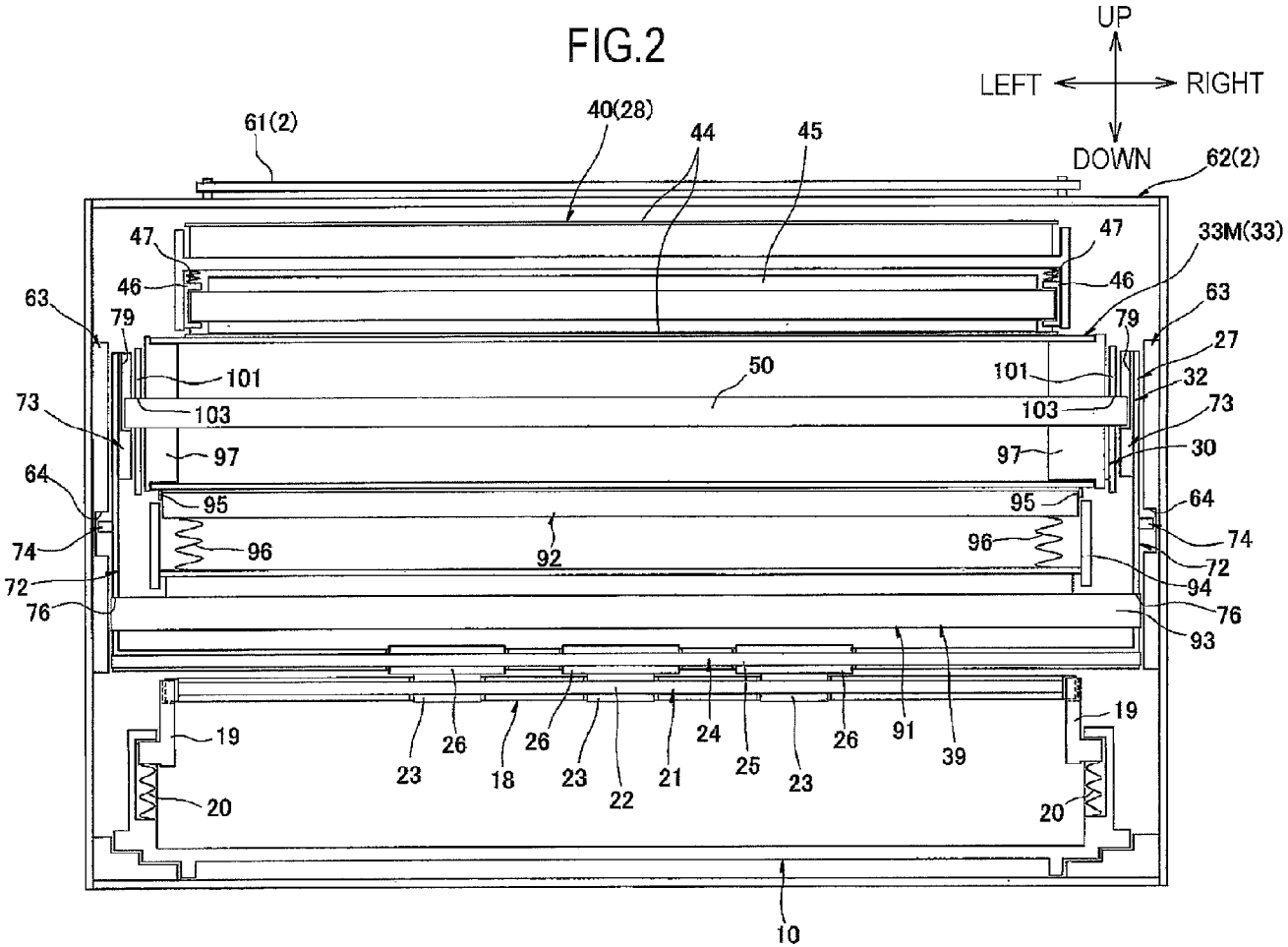
FIG. 2 is a sectional view of the color printer taken along a line II-II in FIG. 1.

As shown in FIGS. 1 and 2, the image forming apparatus according to the first embodiment is a horizontal intermediate transfer type color printer 1.

The color printer 1 is a multifunction apparatus that is integrally provided with a main casing 2 and a flatbed scanner 3 disposed above the main casing 2. The flatbed scanner 3 is for reading image data from original documents.

Within the main casing 2, the color printer 1 is further provided with a sheet supply unit 4 and an image forming unit 5. The sheet supply unit 4 functions to supply a sheet of paper P to the image forming unit 5. The image forming unit 5 functions to form an image on the sheet of paper P supplied from the sheet supply unit 4.

(1) Main Casing

The main casing 2 has a box shape that is substantially rectangular in a side view. The sheet supply unit 4 and the image forming unit 5 are accommodated in the main casing 2. The main casing 2 has one side wall in which an access opening 6 is formed. A front cover 7 is provided on the side wall so as to be pivotally movable about a lower end thereof between a closed position for closing the access opening 6 and an open position for opening the access opening 6. The lower end of the front cover 7 serves as a fulcrum.

An opening 8 is formed in a lower portion of the front cover 7 for exposing the front end of a sheet supply tray 10 (described later). A manual-sheet-feed guide 9 is provided on the front cover 7. The manual-sheet-feed guide 9 extends obliquely rearward and downward from the upper edge of the opening 8 toward a position between the bottom wall of a process frame 32 (described later) and the front end of a sheet-conveying member 18 (described later).

The terms "upward", "downward", "upper", "lower", "above", "below", "beneath", "right", "left", "front", "rear" and the like will be used throughout the description assuming that the color printer 1 is disposed in an orientation in which it is intended to be used. In the following description, the side of the color printer 1 on which the front cover 7 is provided (left side in FIG. 1) will be referred to as the front side of the color printer 1, and a side opposite to the front side (right side in FIG. 1) will be referred to as the rear side of the color printer 1. The top, bottom, left, and right sides of the color printer 1 in the following description will be based on the reference point of a user viewing the color printer 1 from the front side.

(2) Sheet Supply Unit

The sheet supply unit 4 includes a sheet supply tray 10 for accommodating sheets of paper P.

The sheet supply tray 10 is removably mounted in the bottom section of the main casing 2. A grip part 11 is provided on the front wall of the sheet supply tray 10 near the top edge thereof. The grip part 11 has a general U-shape in cross section with the opening of the U-shape facing downward. The top surface of the grip part 11 vertically opposes the manual-sheet-feed guide 9, with a gap formed therebetween. The gap formed between the top surface of the grip part 11 and the manual-sheet-feed guide 9 defines a manual-sheet-feed opening 12 through which sheets of paper P other than those accommodated in the sheet supply tray 10 may be hand-fed.

The sheet supply unit 4 includes a pick-up roller 13, a feeding roller 14, a feeding pad 15, a pair of pinch rollers 16, and a pair of registration rollers 17. The pick-up roller 13 is disposed above a rear end portion of the sheet supply tray 10. The feeding roller 14 is disposed rearward of the pick-up roller 13. The feeding pad 15 is disposed below and opposite the feeding roller 14. The pair of pinch rollers 16 opposes each other in a vertical direction. The pair of pinch rollers 16 is disposed rearward of the feeding roller 14 and contact the feeding roller 14. The pair of registration rollers 17 opposes each other in the front-to-rear direction and disposed above the feeding roller 14.

The sheets P (indicated by a solid line shown in FIG. 1) accommodated in the sheet supply tray 10 are conveyed between the feeding roller 14 and the feeding pad 15 in association with rotation of the pick-up roller 13, and separated sheet by sheet in association with rotation of the feeding roller 14. Then, in association with rotation of the feeding roller 14, the separated sheet P is conveyed toward the registration rollers 17 while passing between the feeding roller 14 and each pinch roller 16. In association with rotation of the registration rollers 17, the sheet P is conveyed to the image forming unit 5 (between an intermediate transfer belt 44 (described later) and a secondary transfer roller 41 (described later) at a prescribed timing. This conveying path extending from the sheet supply tray 10 to the image forming unit 5 through the feeding roller 14, the pinch rollers 16, and the registration rollers 17 corresponds to a first conveying path.

A manual-sheet-feed path is formed in the sheet supply unit 4 between the sheet supply tray 10 and the bottom wall of a process frame 32 (described later).

A sheet-conveying member 18 is provided in the sheet supply tray 10. The sheet-conveying member 18 constitutes the bottom wall of the manual-sheet-feed path and confronts the bottom wall of a process frame 32 (described later).

The sheet-conveying member 18 has a generally flat plate shape that is elongated in the front-to-rear direction. The sheet-conveying member 18 can be moved vertically while being maintained in a level orientation (see FIGS. 7 and 8) through a pair of left and right support members 19 and various compression springs 20 (see FIG. 2).

Five tray-side conveying members 21 are rotatably provided in the sheet-conveying member 18 at intervals in the front-to-rear direction. Each tray-side conveying member 21 includes a single tray-side roller shaft 22, and three tray-side roller members 23 provided on the tray-side roller shaft 22 so as to be incapable of rotating relative thereto (see FIG. 2).

Five process-side conveying members 24 are rotatably provided on the bottom wall of the process frame 32 (described later) at positions opposing the tray-side conveying members 21. Each process-side conveying member 24 includes a single process-side roller shaft 25, and three process-side roller members 26 provided on the process-side roller shaft 25 so as to be incapable of rotating relative thereto (see FIGS. 2 and 3).

The sheet of paper P hand-fed through the manual-sheet-feed opening 12 (indicated by a dashed line in FIG. 1) is guided by the manual-sheet-feed guide 9 on the front cover 7 and the top surface of the grip part 11 provided on the sheet supply tray 10 to a nip part between the forwardmost process-side conveying members 24 and the forwardmost tray-side conveying members 21. Each of the process-side conveying members 24 is driven to rotate while the corresponding tray-side conveying members 21 follow, conveying the hand-fed sheet in a rearward direction between the bottom surface of the process frame 32 described later and the top surface of the sheet-conveying member 18.

The hand-fed sheets of paper P are guided to the pick-up roller 13 at the rear end of the sheet-conveying member 18 and conveyed between the feeding roller 14 and feeding pad 15 by the rotation of the pick-up roller 13, as described above. The feeding roller 14 then supplies the sheets of paper P sequentially through the feeding roller 14 and pinch rollers 16 toward the registration rollers 17 disposed above the feeding roller 14. The rotating registration rollers 17 supply the sheets to the nip position N between the intermediate transfer belt 44 and the secondary transfer roller 41, both described later, at a prescribed timing.

(3) Image Forming Unit

The image forming unit 5 is disposed above the sheet supply unit 4. The image forming unit 5 includes a process unit 27, a transfer unit 28, and a fixing unit 29.

(3-1) Process Unit

The process unit 27 is disposed above the sheet supply tray 10 and frontward of the pick-up roller 13. Further, the process unit 27 is movable in the front-to-rear direction between a mounted position in which the process unit 27 is mounted in the main casing 2 and a pulled-out position in which the process unit 27 is pulled out of the main casing 2. That is, the process unit 27 is slidably mounted in the main casing 2 in the front-to-rear direction.

The process unit 27 includes one drum unit 30, four developer cartridges 31 corresponding to the four colors used in image formation, and a process frame 32 for retaining the drum unit 30 and developer cartridges 31 in a detachably mounted state.

(3-1-1) Drum Unit

The drum unit 30 is disposed in the top portion of the process unit 27. The drum unit 30 integrally holds four photosensitive drums 33 corresponding to the four colors used in image formation, and four Scorotron chargers 34 corresponding to the photosensitive drums 33.

The photosensitive drums 33 are juxtaposed with one another and are arranged at intervals in the front-to-rear direction. In other words, the photosensitive drums 33 are arranged in the front-to-rear direction as being spaced apart from one another in the front-to-rear direction. More specifically, the photosensitive drums 33 include a black photosensitive drum 33K, a yellow photosensitive drum 33Y, a magenta photosensitive drum 33M, and a cyan photosensitive drum 33C that are arranged at intervals from the front side toward the rear side in the order given.

Each of the photosensitive drums 33 has a generally cylindrical shape and is oriented with its axis aligned in the left-to-right direction. The photosensitive drum 33 is provided with a pair of flange members 97, and a drum shaft 50 (see FIG. 2).

The flange members 97 are fitted one on each of the left and right ends of the corresponding photosensitive drum 33 so as to be incapable of rotating relative to the ends.

The drum shaft 50 is generally columnar-shaped and is elongated in the front-to-rear direction. The drum shaft 50 is inserted through the photosensitive drum 33 so as to share its central axis with the photosensitive drum 33. The left and right ends of the drum shaft 50 are rotatably supported in the flange members 97 and protrude farther outward from the flange members 97 in the left-to-right direction.

Each Scorotron charger 34 is disposed diagonally below and rearward of the corresponding photosensitive drum 33, and confronts but does not contact the corresponding photosensitive drum 33.

The drum unit 30 is provided with a belt cleaning roller 90.

The belt cleaning roller 90 is rotatably supported in the drum unit 30 at a front side of the black photosensitive drum 33K so as to contact a scraping roller 88 (to be described later) from above.

(3-1-2) Developing Cartridge

The developing cartridges 31 are juxtaposed with one another and are arranged at intervals in the front-to-rear direction such that each developing cartridge 31 is disposed diagonally below and frontward of the corresponding photosensitive drum 33. In other words, the developing cartridges 31 are arranged in the front-to-rear direction as being spaced apart from one another in the front-to-rear direction such that each developing cartridge 31 is disposed diagonally below and frontward of the corresponding photosensitive drum 33. More specifically, the developing cartridges 31 include a black developing cartridge 31K, a yellow developing cartridge 31Y, a magenta developing cartridge 31M, and a cyan developing cartridge 31C that are arranged at intervals from the front side toward the rear side in the order given.

Each developing cartridge 31 includes a developing roller 35.

The developing roller 35 is rotatably supported by an upper end of the developing cartridge 31. An upper rear edge of the developing roller 35 is exposed through an upper rear edge of the developing cartridge 31 and contacts the corresponding photosensitive drum 33 from a front lower side of the photosensitive drum 33.

The developing cartridge 31 also includes a supply roller 36 for supplying toner to the corresponding developing roller 35 and a thickness-regulating blade 37 for regulating the thickness of the toner supplied to the developing roller 35. Further, the developing cartridge 31 includes a toner accommodating section 38 for accommodating therein toner of a corresponding color. The toner accommodating section 38 is disposed below the supply roller 36.

The black developing cartridge 31K includes a waste toner retaining section 87, the scraping roller 88, and a scraping blade 89. The belt cleaning roller 90 serves to clean waste toner deposited on the surface of the intermediate transfer belt 44.

After the waste toner carried on the belt cleaning roller 90 is supplied to the scraping roller 88, the waste toner carried on the scraping roller 88 is scraped off with the scraping blade 89. Hence, the waste toner is retained in the waste toner retaining section 87.

(3-1-3) Process Frame

The process frame 32 is provided slidably in the front-to-rear direction. The process frame 32 is provided with four LED units 39 in one to one correspondence with the four photosensitive drums 33.

Each LED unit 39 is disposed rearward of the corresponding developing cartridge 31. Further, the LED unit 39 is disposed below the corresponding photosensitive drum 33 and confronts the corresponding photosensitive drum 33. The LED unit 39 exposes a surface of the corresponding photosensitive drum 33 based on prescribed image data.

Each LED unit 39 includes an LED array supporting member 91 and an LED array 92 (FIG. 2).

The LED array supporting member 91 includes a support beam 93 and an LED array accommodating member 94.

The support beam 93 is formed in a generally quadrangular prism shape extending in the right-to-left direction. The support beam 93 spans between right and left side walls 72 of the process frame 32.

The LED array accommodating member 94 is formed in a generally rectangular frame shape having a bottom wall and elongated in the right-to-left direction. The bottom wall of the LED array accommodating member 94 is connected to the support beam 93.

The LED array 92 is formed generally in a rod shape and elongated in the right-to-left direction. The LED array 92 integrally holds a plurality of LEDs arranged in the right-to-left direction therein. The LED array 92 is movable relative to the LED array accommodating member 94. The LED array 92 has a lower portion that is accommodated in an upper portion of the LED array accommodating member 94. The LED array 92 is resiliently supported to the bottom wall of the LED array accommodating member 94 by a pair of right and left compression springs 96 that is interposed between the bottom wall of the LED array accommodating member 94 and the LED array 92.

The LED array 92 has right and left ends, each having an LED positioning member 95 (FIG. 2) for positioning the LED array 92 relative to the corresponding photosensitive drum 33.

Each LED positioning member 95 is formed in a plate shape that is substantially rectangular in a side view. The LED positioning members 95 are arranged to slightly protrude upward from the respective right and left edges of the LED array 92. The LED positioning members 95 contact the photosensitive drum 33 from below due to the urging force by the compression springs 96, thereby positioning the LED array 92 relative to the photosensitive drum 33 such that the LED array 92 is in confrontation with the photosensitive drum 33 and is spaced apart from the photosensitive drum 33 by an interval corresponding to the protruding length of the LED positioning members 95.

(3-3) Transfer Unit

The transfer unit 28 includes a belt unit 40 and the secondary transfer roller 41.

The belt unit 40 is disposed above the process unit 27 when the process unit 27 is in the mounted position so as to confront each photosensitive drum 33 from above and oriented in the front-to-rear direction.

The belt unit 40 includes a drive roller 42, a follow roller 43, the intermediate transfer belt 44, and four primary transfer rollers 45.

The drive roller 42 and the follow roller 43 are arranged in confrontation with and spaced apart from each other in the front-to-rear direction.

The intermediate transfer belt 44 is stretched around the drive roller 42 and the follow roller 43, with a lower portion of the intermediate transfer belt 44 contacting each of the photosensitive drums 33. The intermediate transfer belt 44 is driven by the drive roller 42 to circulate so that the lower portion of the intermediate transfer belt 44 in contact with the photosensitive drums 33 moves rearward.

Figure 7:
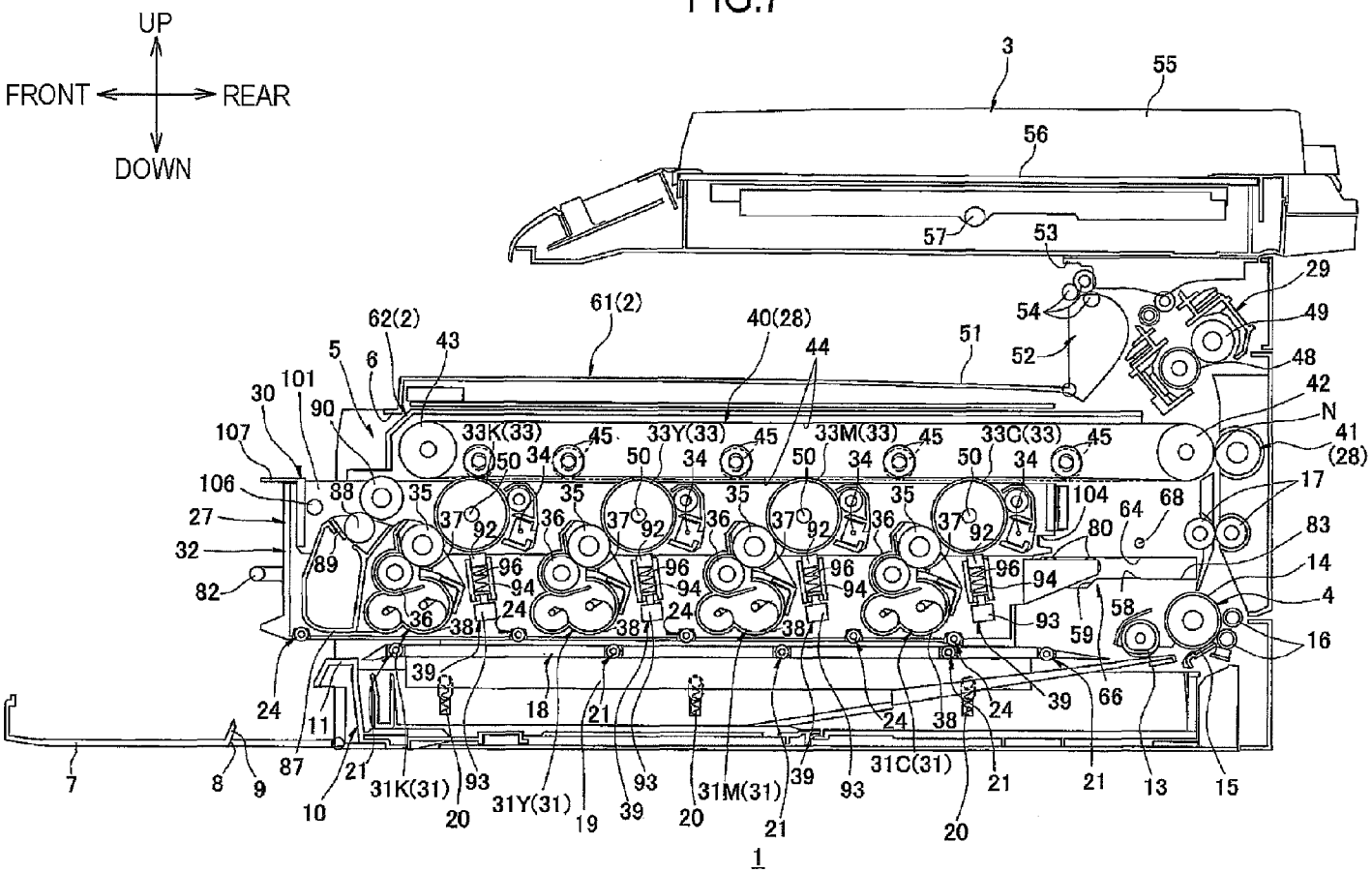

Each primary transfer roller 45 is disposed in confrontation with the corresponding photosensitive drum 33, interposing the lower portion of the intermediate transfer belt 44 between the primary transfer roller 45 and the photosensitive drum 33. Each primary transfer roller 45 is supported by the belt unit 40 at each of its left and right ends via a bearing 46 (FIG. 2) and a compression spring 47 (FIG. 2) such that the primary transfer roller 45 is rotatable and vertically movable relative to the belt unit 40 as shown in FIG. 7.

The secondary transfer roller 41 is disposed rearward of the belt unit 40. Further, the secondary transfer roller 41 is disposed in confrontation with the drive roller 42 of the belt unit 40, interposing the intermediate transfer belt 44 between the secondary transfer roller 41 and the drive roller 42.

(3-4) Fixing Unit

The fixing unit 29 is disposed above the secondary transfer roller 41. The fixing unit 29 includes a heating roller 48 and a pressure roller 49 disposed in confrontation with the heating roller 48.

(3-5) Image Forming Operations (3-5-1) Developing Operation

The toner accommodated in the developing cartridge 31 is supplied to the supply roller 36, and then to the developing roller 35.

As the developing roller 35 rotates, the thickness-regulating blade 37 regulates the toner carried on the surface of the developing roller 35 to a prescribed thickness, so that the developing roller 35 carries a uniform thin layer of toner thereon. The toner supplied to the developing roller 35 is positively tribocharged between the thickness-regulating blade 37 and the developing roller 35.

In the meantime, the Scorotron charger 34 applies uniform charge of positive polarity to a surface of the corresponding photosensitive drum 33 as the photosensitive drum 33 rotates. Subsequently, the LED unit 39 exposes the surface of the corresponding photosensitive drum 33 based on image data. An electrostatic latent image corresponding to an image to be formed on the sheet P is formed on the surface of the photosensitive drum 33.

As the photosensitive drum 33 continues to rotate, the positively charged toner carried on the surface of the developing roller 35 is supplied to the electrostatic latent image formed on the surface of the photosensitive drum 33, thereby developing the electrostatic latent image into a visible toner image through reverse development. Thus, the toner image is formed on the surface of the photosensitive drum 33.

(3-5-2) Transfer and Fixing Operations

The toner images formed on the surfaces of the photosensitive drums 33 through reverse development are primary-transferred in succession onto the lower portion of the intermediate transfer belt 44 that is conveyed rearward from front, thereby forming a color image on the intermediate transfer belt 44.

The color image formed on the intermediate transfer belt 44 is secondary-transferred onto the sheet P supplied from the sheet supply unit 4 while the intermediate transfer belt 44 passes through the nip position N where the intermediate transfer belt 44 confronts the secondary transfer roller 41.

The color image transferred onto the sheet P is thermally fixed to the sheet P by heat and pressure in the fixing unit 29, as the sheet P passes between the heating roller 48 and the pressure roller 49.

(4) Discharge

A discharge tray 51, onto which the sheet P is to be discharged, is formed on a top surface of the main casing 2. A sheet discharging unit 52 is provided in the upper rear end of the main casing 2 to protrude upwardly to a higher level than the discharge tray 51.

The sheet discharging unit 52 has a sheet discharging opening 53 at a level higher than the discharge tray 51. The sheet P is discharged through the sheet discharging opening 53. The sheet discharging unit 52 has a plurality of (three, in this example) sheet discharge rollers 54 disposed in the sheet discharging opening 53 for conveying the sheet P toward the discharge tray 51.

After the color image has been fixed to the sheet P in the fixing unit 29, the sheet P is discharged by the discharge rollers 54 onto the discharge tray 51.

(5) Flatbed Scanner

The flatbed scanner 3 is supported by the upper end of the sheet discharging unit 52 such that the flatbed scanner 3 is disposed above and spaced apart from the discharge tray 51. The flatbed scanner 3 includes a restraining cover 55, a glass plate 56, and a CCD sensor 57. After an original document is placed between the restraining cover 55 and the glass plate 56, the CCD sensor 57 is slidingly moved to read image data from the original document.

2. Process Unit (1) Process Frame

Figure 3:
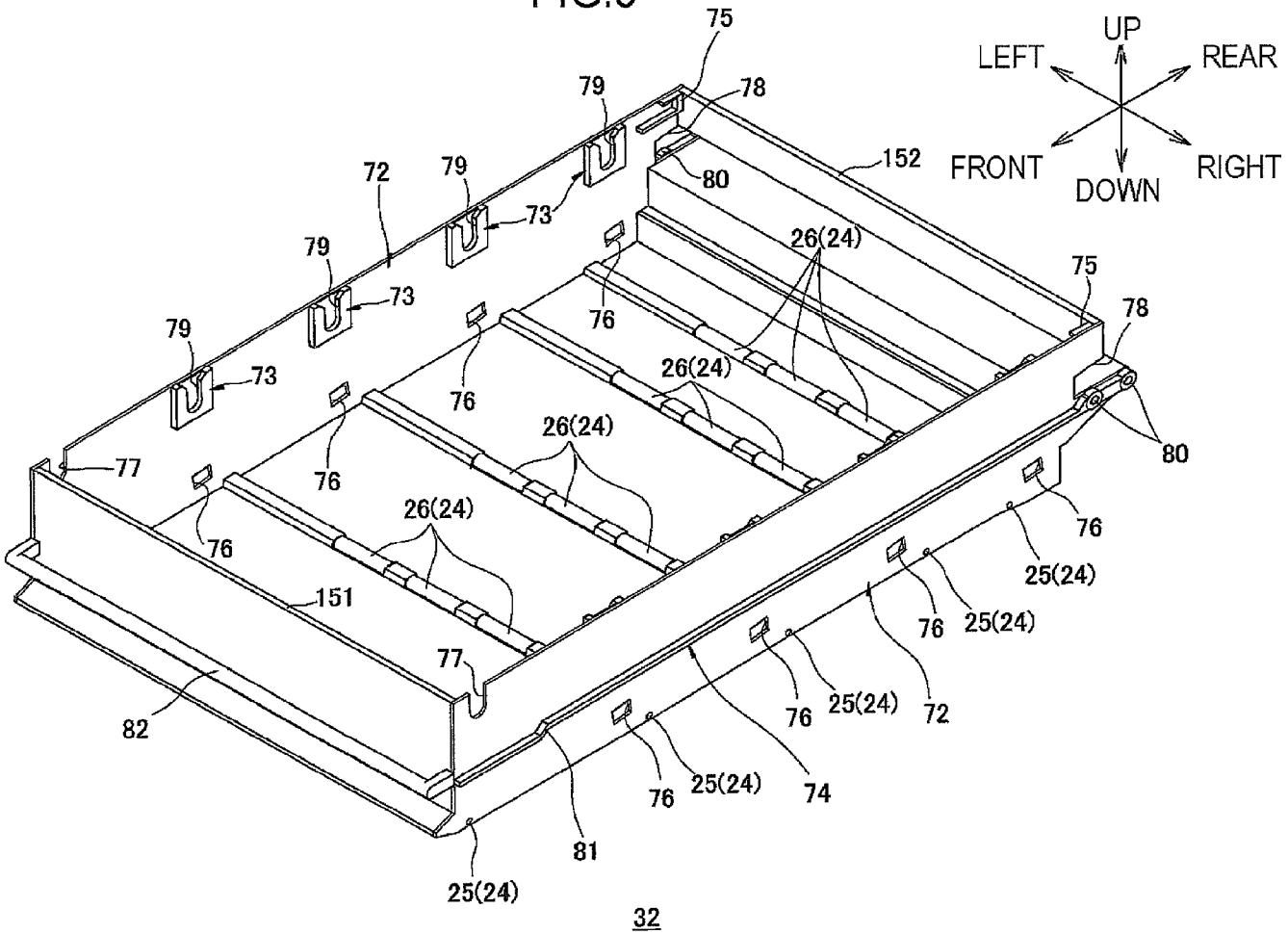
FIG. 3 is a perspective view of a process frame shown in FIG. 1 and viewed from an upper front side thereof.
Figure 5:
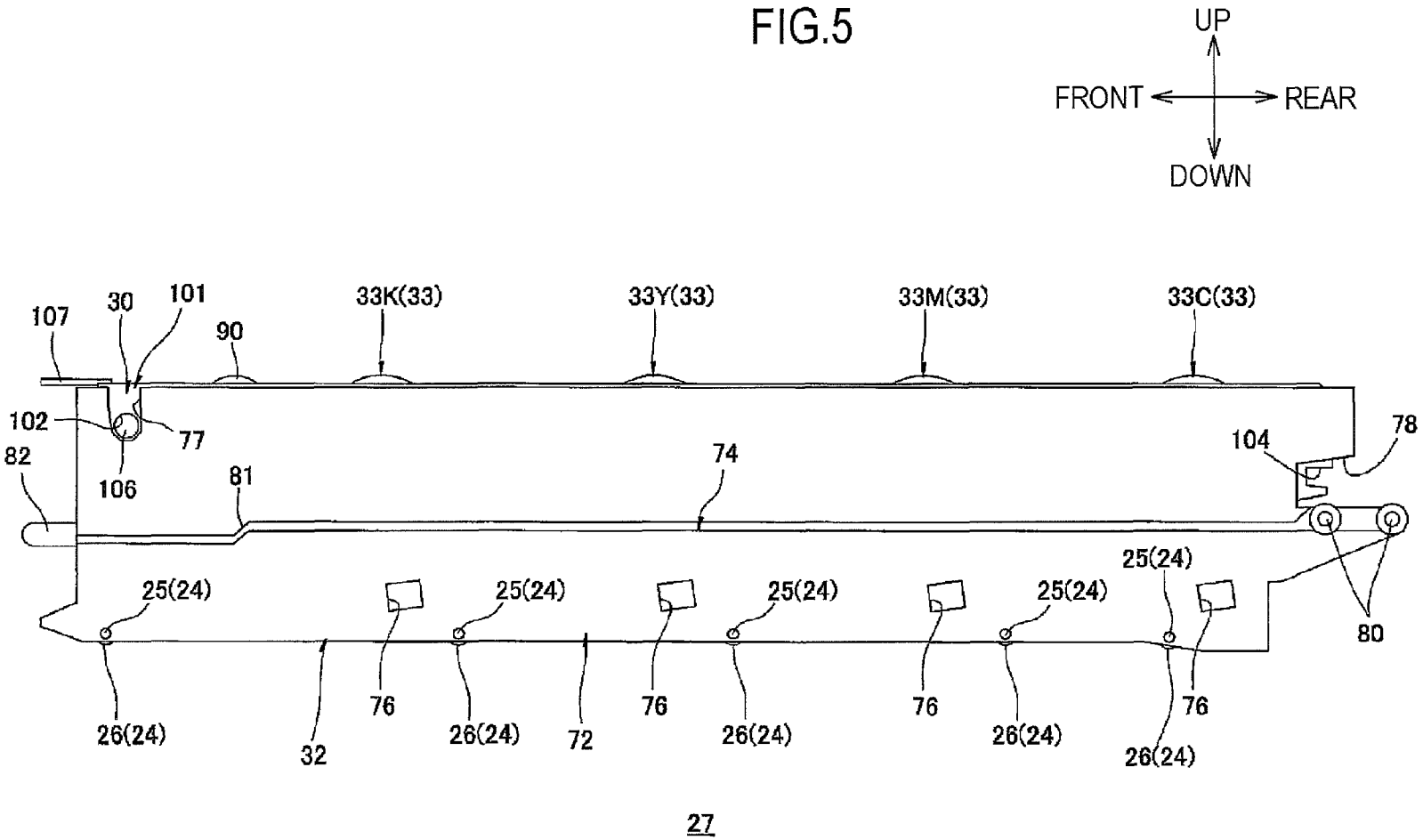
FIG. 5 is a right side view of a process unit shown in FIG. 1.

As shown in FIGS. 3 and 5, the process frame 32 has a generally rectangular frame-like structure with a closed bottom and open top. The process frame 32 includes a pair of side walls 72 arranged parallel to each other and separated in the left-to-right direction, a front wall 151 and a rear wall 152 spanning between the side walls 72, and a process-frame-side handle 82.

The front wall 151 bridges the front ends of the side walls 72, while the rear wall 152 bridges the rear ends of the side walls 72.

Each of the side walls 72 is provided with four drum guide members 73, a guide rail 74, and an engaging member 75. In addition, each side wall 72 has formed therein a positioning-shaft exposure groove 77, a fitting-part exposure groove 78, and four LED support through-holes 76.

The drum guide members 73 are fixed to the inner surface of each side wall 72 with respect to the left-to-right direction and are arranged along the upper edge of the side wall 72 at intervals in the front-to-rear direction. The positions of the drum guide members 73 correspond to the photosensitive drums 33. Each drum guide member 73 has a generally rectangular plate shape in a side view. A drum guide groove 79 is formed in each drum guide member 73.

Each of the drum guide grooves 79 is a cutout formed in the top edge of the drum guide member 73 and extending downward. The drum guide groove 79 is generally U-shaped in a side view and is open at the top. The drum guide grooves 79 have a width (left-to-right dimension) sufficient for receiving the drum shaft 50 of the corresponding photosensitive drum 33.

The guide rail 74 is formed in the approximate vertical center of each side wall 72 as a generally linear ridge that extends in the front-to-rear direction. The guide rail 74 protrudes outward from the outer surface of the side wall 72 in the respective left or right direction. A sloped part 81 is formed at a midway point of the guide rail 74, and a pair of front and rear guide rollers 80 are provided in the rear end portion of the guide rail 74.

The sloped part 81 is formed in a portion of the guide rail 74 forward of the front-to-rear center thereof and slopes downward toward the front. The front end of the guide rail 74 is formed continuously with the bottom end of the sloped part 81 and is generally linear, extending forward therefrom.

The guide rollers 80 are rotatably supported in the rear end of each guide rail 74, with their top portions exposed above the top edge of the guide rail 74 and the bottom portions exposed below the bottom edge of the guide rail 74.

Each engaging member 75 is formed on the inner surface of the respective side wall 72 in the upper rear corner of the same. The engaging members 75 are ridges that curve to form a general U-shape in a side view, with the opening of the U-shape facing forward. The ridge-like engaging members 75 protrude inward from the inner surfaces of the side walls 72. The upper and lower edges of each engaging member 75 extend generally parallel to each other and are separated vertically by a gap sufficient for receiving an engagement roller 105 (described later) provided on the drum unit 30. Note that the bottom portion of the engaging member 75 is formed longer than the top portion in the front-to-rear direction so that the front end of the bottom portion protrudes farther forward than the front end of the top portion.

One of the positioning-shaft exposure grooves 77 is formed in the upper edge of each side wall 72 on the front side thereof at a position above the corresponding guide rail 74. The positioning-shaft exposure grooves 77 are cutouts that are recessed downward from the top edge of the side walls 72 and are generally U-shaped in a side view, with the opening of the U-shape facing upward.

One of the fitting-part exposure grooves 78 is formed in the rear end of each side wall 72 at a position below the engaging member 75 and above the guide rail 74. The fitting-part exposure grooves 78 are cutouts that are recessed forward from the rear edges of the side walls 72 and are generally U-shaped in a side view, with the opening of the U-shape facing rearward.

The LED support through-holes 76 are formed in the bottom end of the side wall 72 at intervals in the front-to-rear direction corresponding to positions below respective drum guide grooves 79. Each of the LED support through-holes 76 is generally rectangular in a side view and penetrates the side wall 72 left-to-right. The left and right ends of the support beam 93 in the LED unit 39 are fitted into the corresponding LED support through-holes 76.

The process-frame-side handle 82 is provided on the front wall 151 of the process frame 32 so as to protrude forward therefrom. The process-frame-side handle 82 is shaped in a general U-shape in a plan view, opening rearward, and has a left-to-right length spanning the entire left-to-right dimension of the process frame 32.

(2) Drum Unit

Figure 4:
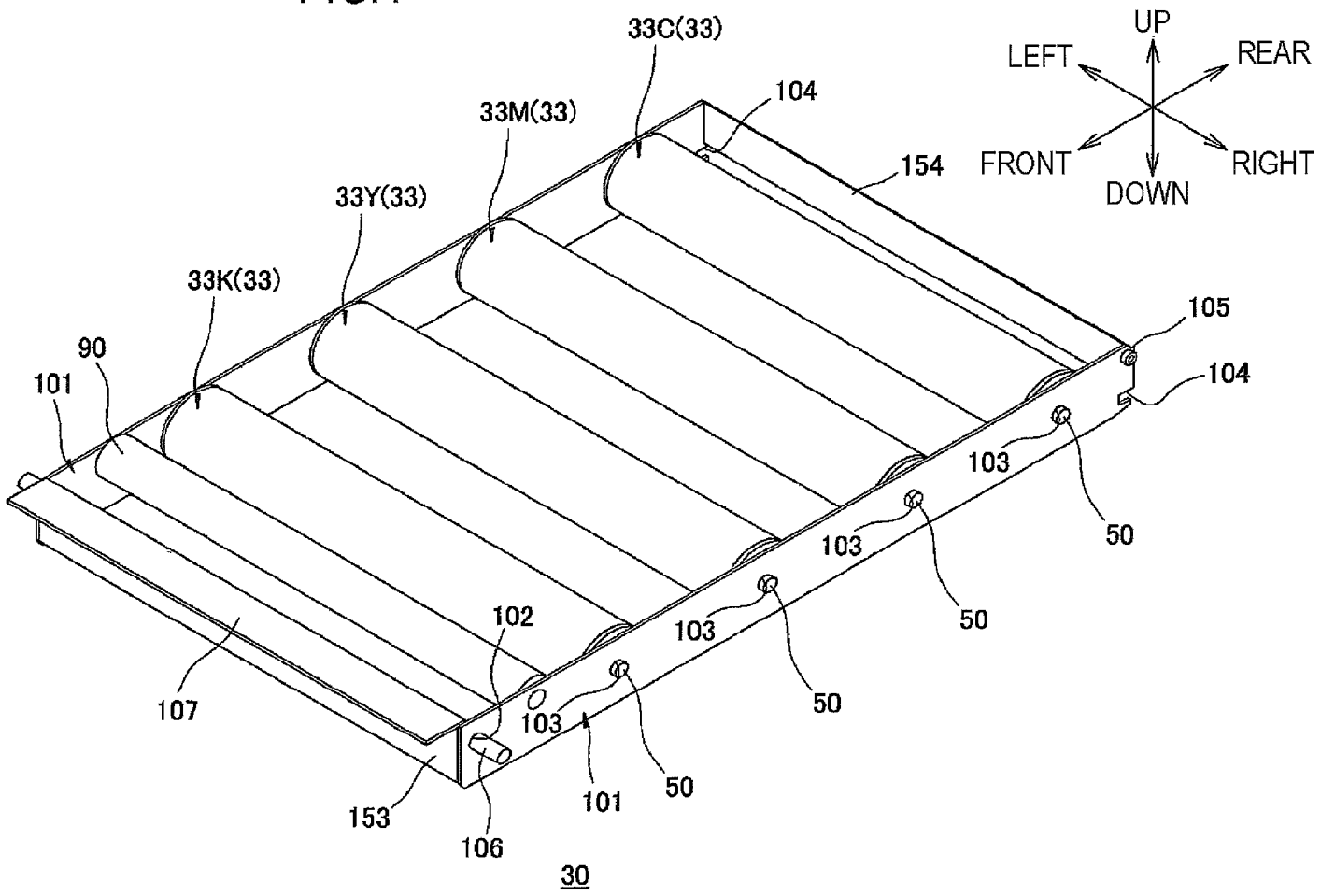
FIG. 4 is a perspective view of a drum unit shown in FIG. 1 and viewed from an upper front side thereof.

As shown in FIG. 4, the drum unit 30 has a generally rectangular frame-like structure open on both the top and bottom. The drum unit 30 includes a front plate 153, a rear plate 154, a pair of left and right side plates 101 bridged by the front plate 153 and rear plate 154, a positioning shaft 106, and a drum-unit-side handle 107.

The front plate 153 bridges the front ends of the side plates 101, while the rear plate 154 bridges the rear ends of the side plates 101.

Each side plate 101 has a flat plate shape, is generally rectangular in a side view, and is formed of a highly rigid material, such as a sheet of steel, stainless steel, or the like. The side plates 101 are oriented parallel to each other and separated in the left-to-right direction by an interval smaller than that separating the side walls 72 of the process frame 32. Each side plate 101 has formed therein a positioning-shaft insertion through-hole 102, four drum-shaft insertion through-holes 103, and a fitting part 104. Each side plate 101 also has an engagement roller 105.

The positioning-shaft insertion through-hole 102 is formed in the front end of each side plate 101. The positioning-shaft insertion through-hole 102 is generally circular in a side view and penetrates the side plate 101 left-to-right. The positioning-shaft insertion through-holes 102 have a diameter substantially equal to (slightly larger than) the outer diameter of the positioning shaft 106.

The drum-shaft insertion through-holes 103 are spaced at intervals in the front-to-rear direction to the rear side of the positioning-shaft insertion through-hole 102. Each of the drum-shaft insertion through-holes 103 is generally circular in a side view and penetrates the side plate 101 left-to-right. The drum-shaft insertion through-holes 103 have a diameter substantially equal to (slightly larger than) the outer diameter of the drum shaft 50. The left and right ends of each drum shaft 50 are rotatably inserted into the corresponding drum-shaft insertion through-holes 103 formed in the left and right side plates 101 so as to protrude further outward therefrom in respective left and right directions.

The fitting part 104 is a cutout formed in the rear edge of each side plate 101 near the lower side thereof. The fitting parts 104 are generally U-shaped in a side view, opening rearward, and are recessed in a forward direction from the rear edges of the side plates 101.

Each of the engagement rollers 105 is disposed on the rear end of the drum unit 30 above the corresponding fitting part 104. The engagement rollers 105 are generally disc-shaped and are formed with a prescribed left-to-right thickness. The engagement rollers 105 are rotatably supported on the respective outer surfaces of the left and right side plates 101. Hence, the engagement rollers 105 protrude outward from the left and right side plates 101 in respective left and right directions by a distance equivalent to their thickness.

The positioning shaft 106 is generally columnar in shape and elongated in the left-to-right direction. The positioning shaft 106 is inserted into the positioning-shaft insertion through-holes 102 formed in the side plates 101 at the front end of the drum unit 30. The left and right ends of the positioning shaft 106 protrude outward in left and right directions from the left and right outer surfaces of respective side plates 101.

The drum-unit-side handle 107 protrudes forward from the top edge of the front plate 153. The drum-unit-side handle 107 has a flat plate shape and is generally rectangular in a plan view, with a left-to-right length spanning the entire left-to-right dimension of the drum unit 30.

As shown in FIG. 5, the drum unit 30 is supported on the top edge of the process frame 32 between the side walls 72 by engaging the engagement rollers 105 of the drum unit 30 in the rear ends of the corresponding engaging members 75 provided on the process frame 32 (see FIGS. 3 and 4) and by engaging the ends of the positioning shaft 106 in respective positioning-shaft exposure grooves 77 formed in the process frame 32.

In this state, the front edge of the drum-unit-side handle 107 protrudes farther forward than the front wall 151 of the process frame 32. Further, the fitting parts 104 are exposed in the fitting-part exposure grooves 78 of the process frame 32 when viewed from the side. The ends of the positioning shaft 106 protrude outward in left and right directions from respective positioning-shaft exposure grooves 77 formed in the process frame 32. That is, the ends of the positioning shaft 106 protrude further outwardly than the process frame 32. The drum unit 30 is rotatably supported about the engagement rollers 105 (see FIG. 10).

3. Main Casing (1) Configuration of the Main Casing

The main casing 2 includes an outer casing 61 and an inner casing 62 (FIG. 2). The outer casing 61 defines an outer shell of the color printer 1. The inner casing 62 is provided inside the outer casing 61.

The outer casing 61 is formed in a generally box-shape and is made of an insulating material such as resin. The outer casing 61 has a front edge on which the front cover 7 is provided.

The inner casing 62 is of a hollow rectangular cuboid configuration and elongated in the front-to-rear direction. The inner casing 62 is made of a highly rigid material such as metal. The inner casing 62 has a vertical length and a lateral (right to left) length such that the process unit 27, the belt unit 40, and the sheet supply tray 10 can be accommodated therein. The inner casing 62 is accommodated in the outer casing 61 such that the top wall of the inner casing 62 is spaced apart from that of the outer casing 61. The belt unit 40 is accommodated in the upper part of the inner casing 62, while the sheet supply tray 10 is detachably accommodated in the lower part of the inner casing 62.

Figure 6:
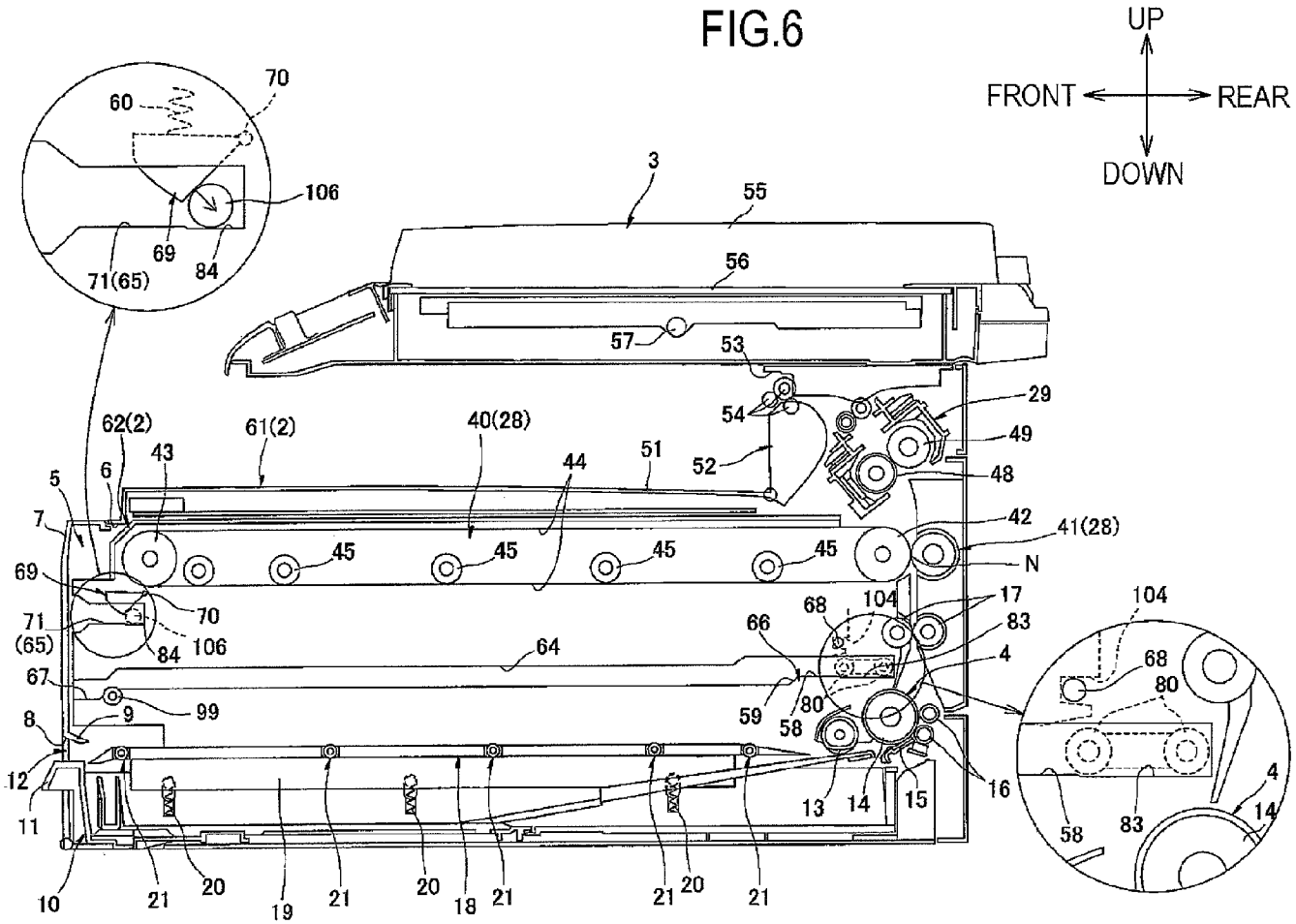
FIG. 6 is a cross-sectional view of a main casing shown in FIG. 1.

As shown in FIGS. 2 and 6, the inner casing 62 is provided with a pair of left and right guide plates 63, and a reference shaft 68.

The guide plates 63 are fixed to the left and right inner surfaces of the inner casing 62 at positions between the belt unit 40 and sheet supply tray 10 and confront the corresponding left and right outer sides of the process unit 27. The guide plates 63 are formed of a resin material in a general plate shape that is elongated vertically and in the front-to-rear direction. The guide plates 63 function to guide movement of the process frame 32. Specifically, a first guide groove 64 for guiding the rear end of the process unit 27 and a second guide groove 65 for guiding the front end of the process unit 27 is formed in each of the guide plates 63.

The first guide groove 64 is formed approximately along the vertical center of the guide plate 63 and extends along a generally linear path in the front to rear direction. The first guide grooves 64 are recesses formed in the inner left and right surfaces of the guide plates 63 having a width (vertical dimension) sufficient for receiving the guide rollers 80 of the process frame 32 and spanning nearly the entire front-to-rear length of the inner casing 62. Further, a raised step 66 is formed in the bottom edge of the first guide groove 64 near the rear end thereof. The raised step 66 expands upward. A lowered step 67 is also formed in the bottom edge of each first guide groove 64 near the front end thereof. The lowered step 67 is recessed downward.

The raised step 66 forms a part of a general trapezoidal shape in a side view, in which the upper base is shorter than the lower base. The raised step 66 has a front surface 59 that slopes upward toward the rear, and a top surface 58 extending continuously rearward from the top end of the front surface 59. A recessed part 83 is formed as a slight downward depression in the rear end portion of the top surface 58 (see the enlarged view in FIG. 6). The upper wall of the first guide groove 64 at the rear end portion thereof is also recessed upward to follow the raised step 66.

The lowered step 67 forms a part of a general trapezoidal shape in a side view, in which the lower base is shorter than the upper base. The rear surface of the lowered step 67 slopes downward toward the front, while the bottom surface extends continuously forward from the bottom end of the rear surface.

A stopper roller 99 is provided in the first guide groove 64 at the rear side of the lowered step 67. The stopper roller 99 is rotatably supported in the guide plate 63, with the top portion thereof exposed above the lower edge of the first guide groove 64. Thus, one stopper roller 99 is provided on each guide plate 63.

The top edge of the first guide groove 64 at the front end thereof protrudes downward toward the top of the stopper roller 99 and forms a gap therebetween sufficient to restrict passage of the guide rollers 80 while allowing passage of the guide rail 74.

The second guide groove 65 is formed above the front end of each first guide groove 64. The second guide groove 65 is generally linear, extending in the front-to-rear direction, and has a width (vertical dimension) sufficient for receiving the end of the positioning shaft 106 provided in the drum unit 30. The front end of the second guide groove 65 is tapered so that the width of the groove expands gradually toward the front. A recessed part 84 is formed in a bottom edge 71 as a slight downward depression at the rear end of the second guide groove 65 (see the enlarged view in FIG. 6).

A pressing cam 69 is provided above the second guide groove 65. Thus, one pressing cam 69 is provided on each guide plate 63. The pressing cam 69 is generally triangular in shape in a side view, with one of its vertices pointing downward. More specifically, the front surface of the pressing cam 69 slopes downward toward the rear, while the rear surface slopes downward toward the front. A rotational shaft 70 rotatably supports the pressing cam 69 at the rear end thereof, enabling the pressing cam 69 to rotate between an advanced position (see FIG. 6) in which the lower end (vertex) is advanced into the second guide groove 65, and a retracted position (not shown) in which the lower end is retracted from the second guide groove 65. A compression spring 60 disposed so as to contact the top of the pressing cam 69 constantly urges the pressing cam 69 downward. Thus, one compression spring 60 is provided on each guide plate 63.

The reference shaft 68 has a generally columnar shape and bridges the left and right side walls of the inner casing 62 on the rear end thereof.

(2) Positioning the Drum Unit in the Main Casing

When the process unit 27 is in the mounted position shown in FIGS. 1 and 6, the left and right ends of the positioning shaft 106 provided in the drum unit 30 are fitted into corresponding recessed parts 84 formed in the second guide grooves 65 of the inner casing 62. The fitting parts 104 of the drum unit 30 are also fitted around the reference shaft 68 provided in the main casing 2 from the front side thereof.

The positioning shaft 106 is pressed in a direction downward and rearward by the pressing cams 69 in the main casing 2 that contact the left and right ends of the positioning shaft 106 from the upper front side thereof (see FIG. 6). Accordingly, the positioning shaft 106 is positioned relative to the recessed parts 84 of the second guide grooves 65, while the fitting parts 104 are positioned relative to the reference shaft 68, thereby positioning the drum unit 30 relative to the belt unit 40.

At this time, the guide rollers 80 provided on the process frame 32 are fitted into the recessed parts 83 formed in the first guide grooves 64 of the inner casing 62 (see FIG. 6). In addition, the guide rails 74 on the process unit 27 confront the tops of corresponding stopper rollers 99 provided in the main casing 2 at portions of the guide rails 74 forward of the sloped parts 81.

4. Mounting and Removing the Drum Unit with Respect to the Main Casing

To remove the drum unit 30 from the main casing 2, first the operator rotates the front cover 7 into the open position to expose the access opening 6, as illustrated in FIG. 7. Next, the operator grips the process-frame-side handle 82 and pulls the process unit 27 forward. Through this operation, the positioning shaft 106 of the drum unit 30 is extracted from the recessed parts 84 of the second guide grooves 65 in a direction upward and forward as the pressing cams 69 are retracted into a retracted position against the urging force of the compression springs 60 (see FIG. 6).

At the same time, the guide rollers 80 on the process frame 32 are extracted from the recessed parts 83 of the first guide grooves 64 formed in the inner casing 62 in a direction upward and forward. As a result, the process unit 27 is raised slightly upward. The intermediate transfer belt 44 and primary transfer rollers 45 are also raised against the urging force of the compression springs 47 (see FIG. 2) as the process unit 27 rises.

As the operator continues to pull the process unit 27 forward, the positioning shaft 106 of the drum unit 30 separates from the front ends of the second guide grooves 65. Thereafter, the rear guide rollers 80 of the process frame 32 reach the front surfaces 59 of the raised steps 66 formed in the first guide grooves 64 (see FIG. 7) just before the black photosensitive drum 33K contacts the follow roller 43. At this time, the sloped parts 81 formed in the guide rails 74 of the process frame 32 are positioned above the stopper rollers 99 (see FIGS. 5 and 6).

Figure 8:
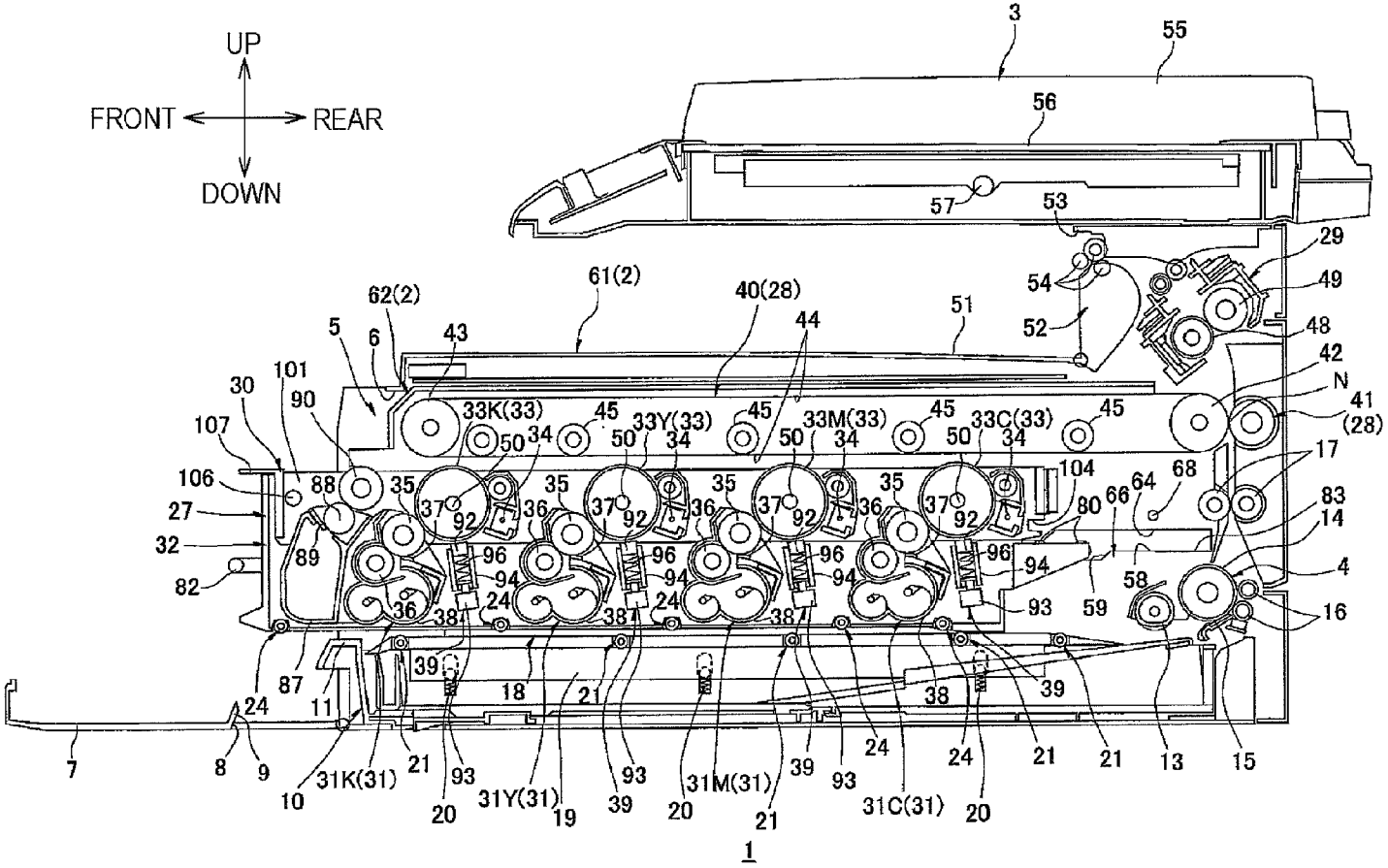

As the operator continues to pull the process unit 27 forward, the rear guide rollers 80 are guided in a downward and forward direction by the sloped front surfaces 59 of the raised steps 66, and the process unit 27 moves downward and forward so that the black photosensitive drum 33K does not contact the follow roller 43, as illustrated in FIG. 8. During this operation, the sloped parts 81 formed in the guide rails 74 pass over the top of the stopper rollers 99 so that the portion of the guide rails 74 rearward of the sloped parts 81 opposes the top of the stopper rollers 99 (see FIGS. 5 and 6). The sheet-conveying member 18 of the sheet supply tray 10 also moves downward together with the downward movement of the process unit 27.

As the operator continues pulling the process unit 27 forward, the guide rollers 80 roll within the first guide grooves 64 and the guide rails 74 slide over the stopper rollers 99 along with the forward movement of the process unit 27.

Figure 9:
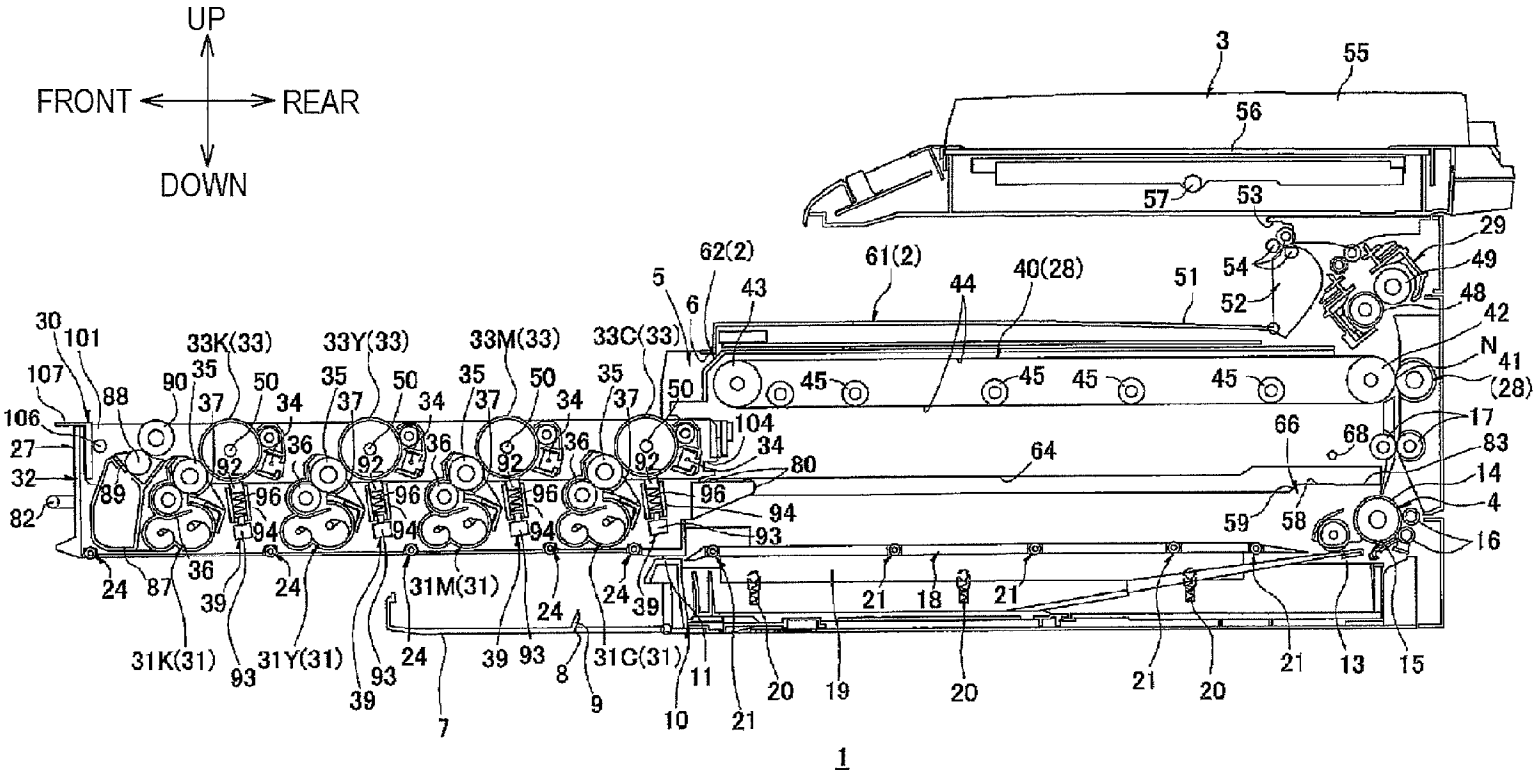

When the front guide rollers 80 contact the corresponding stopper rollers 99 from the rear side, as shown in FIG. 9, the process unit 27 is restricted from moving further forward. At this time, the process unit 27 is in the pulled-out position and the drum unit 30 can be removed from the process unit 27.

Figure 10:
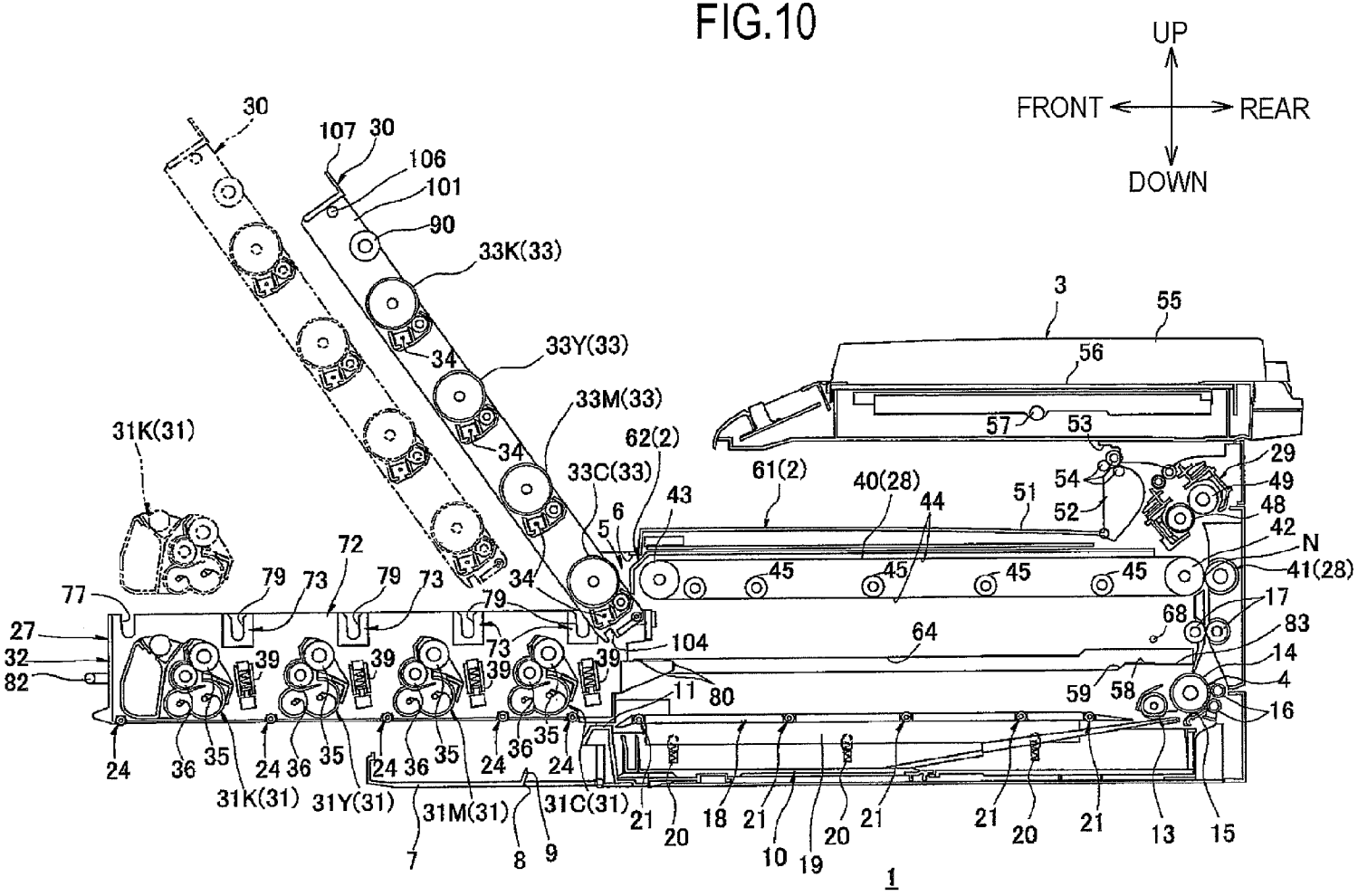
FIG. 10 illustrates how the drum unit and developing cartridges are mounted to and removed from the process unit when the process unit is in the pulled-out position.

In order to remove the drum unit 30 from the main casing 2, the operator grips the drum-unit-side handle 107 on the drum unit 30 while gripping the process-frame-side handle 82 to hold the process frame 32 fixed in the pulled-out position, and lifts the front end of the drum unit 30 upward, as shown in FIG. 10. Through this operation, the positioning shaft 106 rises upward out of the positioning-shaft exposure grooves 77, while the drum unit 30 rotates clockwise in a right side view about the engagement rollers 105 (i.e., the rear end of the drum unit 30).

From this state, the drum unit 30 is pulled forward and then upward to remove the drum unit 30 from the main casing 2. This operation disengages the engagement rollers 105 from the engaging members 75 provided on the process frame 32, separating the drum unit 30 from the process frame 32. Note that the developer cartridges 31 remain mounted in the process frame 32 at this time.

In order to mount the drum unit 30 in the main casing 2, the process described above is performed in reverse. That is, first the operator positions the drum unit 30 so that the rear end of the drum unit 30 is above the rear end of the process frame 32. Then the operator inserts the rear end of the drum unit 30 into the rear end of the process frame 32 so that the engagement rollers 105 become engaged in the front ends of the engaging members 75.

Next, the operator slides the rear end of the drum unit 30 rearward in order to engage the engagement rollers 105 in the rear ends of the engaging members 75. The operator then rotates the drum unit 30 counterclockwise in a right side view about the engagement rollers 105 until the positioning shaft 106 is engaged in the corresponding positioning-shaft exposure grooves 77. At this point, the process for mounting the drum unit 30 in the process frame 32 is completed, as illustrated in FIG. 5.

Next, the operator pushes the process unit 27 rearward into the main casing 2. At this time, as shown in FIG. 7, the guide rollers 80 roll up and over the raised steps 66 of the first guide grooves 64 and the positioning shaft 106 becomes engaged in the second guide grooves 65 (see FIG. 6).

As the operator continues to push the process unit 27 rearward into the main casing 2, the positioning shaft 106 contacts the front surfaces of the pressing cams 69 and continues to move rearward while pushing the pressing cams 69 toward the retracted position against the urging force of the compression springs 60 (see FIG. 6). When the positioning shaft 106 passes beneath the pressing cams 69, pushed into their retracted position, and becomes engaged in the recessed parts 84, the guide rollers 80 simultaneously become engaged in the recessed parts 83 formed in the top surfaces 58 of the raised steps 66.

Once the compression springs 60 urge the pressing cams 69 into their advanced position, the process for mounting the process unit 27 into its mounted position is completed. Thereafter, the operator can rotate the front cover 7 back to its closed position.

5. Mounting and Removing the Developer Cartridges Relative to the Process Frame In order to mount the developer cartridges 31 in the process frame 32 or remove the developer cartridges 31 therefrom, the operator first pulls the process unit 27 out of the main casing 2 and rotates the drum unit 30 clockwise in a right side view to expose the top of the process frame 32, as illustrated in FIG. 10.

In order to remove the developer cartridges 31 from the process frame 32, the operator simply pulls the developer cartridges 31 up and out of the process frame 32. To mount developer cartridges 31 into the process frame 32, the operator inserts the developer cartridges 31 into the process frame 32 from above.

6. Operations (1) As shown in FIG. 10, in the color printer 1 according to the embodiment, the drum unit 30 retaining photosensitive drums 33 is detachably retained on the process frame 32. The drum unit 30 can be detached from the process frame 32 upward when the process frame 32 has been pulled to the pulled-out position, as shown in FIG. 10. Hence, the photosensitive drums 33, which all have substantially the same life (replacement period) can be replaced together at the same time.

Further, when mounting the drum unit 30 on and removing the drum unit 30 from the process frame 32, the operator can access the drum unit 30 from above after pulling the process frame 32 to the pulled-out position. Hence, there is no need to provide a separate structure on the drum unit 30 for moving the drum unit 30 relative to the main casing 2. Consequently, the drum unit 30 can be made more compact and at a lower cost.

The drum unit 30 is also easy to mount onto and detach from the process frame 32.

(2) With the color printer 1 of the embodiment, the drum unit 30 can be mounted on and removed from the process frame 32 by rotating the front end of the drum unit 30 about the rear end of the drum unit 30, as illustrated in FIG. 10. Therefore, when mounting the drum unit 30 on or removing the drum unit 30 from the process frame 32, the user can access the drum unit 30 from the front side of the color printer 1 after pulling the process frame 32 into the pulled-out position. As a result, the drum unit 30 is easily mounted on and removed from the process frame 32.

(3) As shown in FIGS. 3 and 4, the drum unit 30 has the engagement rollers 105 on the rear end thereof, and the positioning shaft 106 on the front end. Further, the process frame 32 has the engaging members 75 to engage the engagement rollers 105 for positioning the engagement rollers 105 while allowing rotation of the same, and the positioning-shaft exposure grooves 77 to engage the positioning shaft 106 in order to allow rotation of the drum unit 30. Accordingly, the front end of the drum unit 30 can be rotated about the engagement rollers 105 provided on the rear end through a simple structure.

(4) As shown in FIG. 4, the drum unit 30 has the drum-unit-side handle 107 on the front end. By providing the drum-unit-side handle 107, the operator can easily grip the front end of the drum unit 30, facilitating mounting and removal of the drum unit 30 relative to the process frame 32.

(5) As shown in FIG. 3, the color printer 1 includes the process-frame-side handle 82 that protrudes forward from the front end of the process frame 32. This configuration allows the operator to grip the front end of the process frame 32 easily to move the process frame 32 easily. At the same time, the operator can grip the process-frame-side handle 82 to hold the process frame 32 in position when mounting the drum unit 30 on or removing the drum unit 30 from the process frame 32.

Hence, with this construction, the operator can easily move the process frame 32 and can more easily mount the drum unit 30 on and remove the drum unit 30 from the process frame 32.

(6) As shown in FIG. 3, the guide rails 74 are provided on the side walls 72 for guiding movement of the process frame 32 relative to the main casing 2. Therefore, the process frame 32 can be moved smoothly in relation to the main casing 2.

(7) As shown in FIG. 2, the side walls 72 are disposed in the color printer 1 so as to confront the outer left and right sides of the drum unit 30. Therefore, the drum unit 30 can be placed inside the process frame 32 with respect to the left-to-right direction and, hence, can be made more compact in the left-to-right direction.

(8) In the color printer 1 of the embodiment, four of the developer cartridges 31 are provided in the process frame 32. As shown in FIG. 10, the developer cartridges 31 can be mounted in or removed from the process frame 32 after rotating the drum unit 30. Accordingly, this configuration allows an operator to perform maintenance on all photosensitive drums 33, which have substantially the same service life (replacement period), as a unit and can perform maintenance individually on the developer cartridges 31, which often differ in service life.

(9) As shown in FIG. 4, the photosensitive drums 33 are rotatably provided in the drum unit 30 at fixed positions. Accordingly, the photosensitive drums 33 can be positioned as a unit relative to the belt unit 40 by positioning the drum unit 30 relative to the belt unit 40.

(10) As shown in FIG. 4, the drum unit 30 is provided with the fitting parts 104 in the rear ends of the side plates 101, and the positioning shaft 106 on the front ends of the side plates 101. Hence, as shown in FIG. 6, the drum unit 30 can be fixed in position in the main casing 2 at both front and rear ends.

(11) As shown in FIG. 3, the guide rails 74 are provided below the positioning-shaft exposure grooves 77. With this construction, the guide rails 74 can be placed more efficiently so as not to interfere with the positioning-shaft exposure grooves 77 and positioning shaft 106.

(12) As shown in FIG. 1, the LED units 39 for exposing the corresponding photosensitive drums 33 are provided in the process frame 32. Accordingly, the drum unit 30 can be separated from the process frame 32 upward without interfering with the LED units 39.

7. Second Embodiment

Next, the color printer 1 according to a second embodiment will be described with reference to FIGS. 11 through 20, wherein like parts and components are designated with the same reference numerals used in the first embodiment to avoid duplicating description.

Figures 14A, 14B:
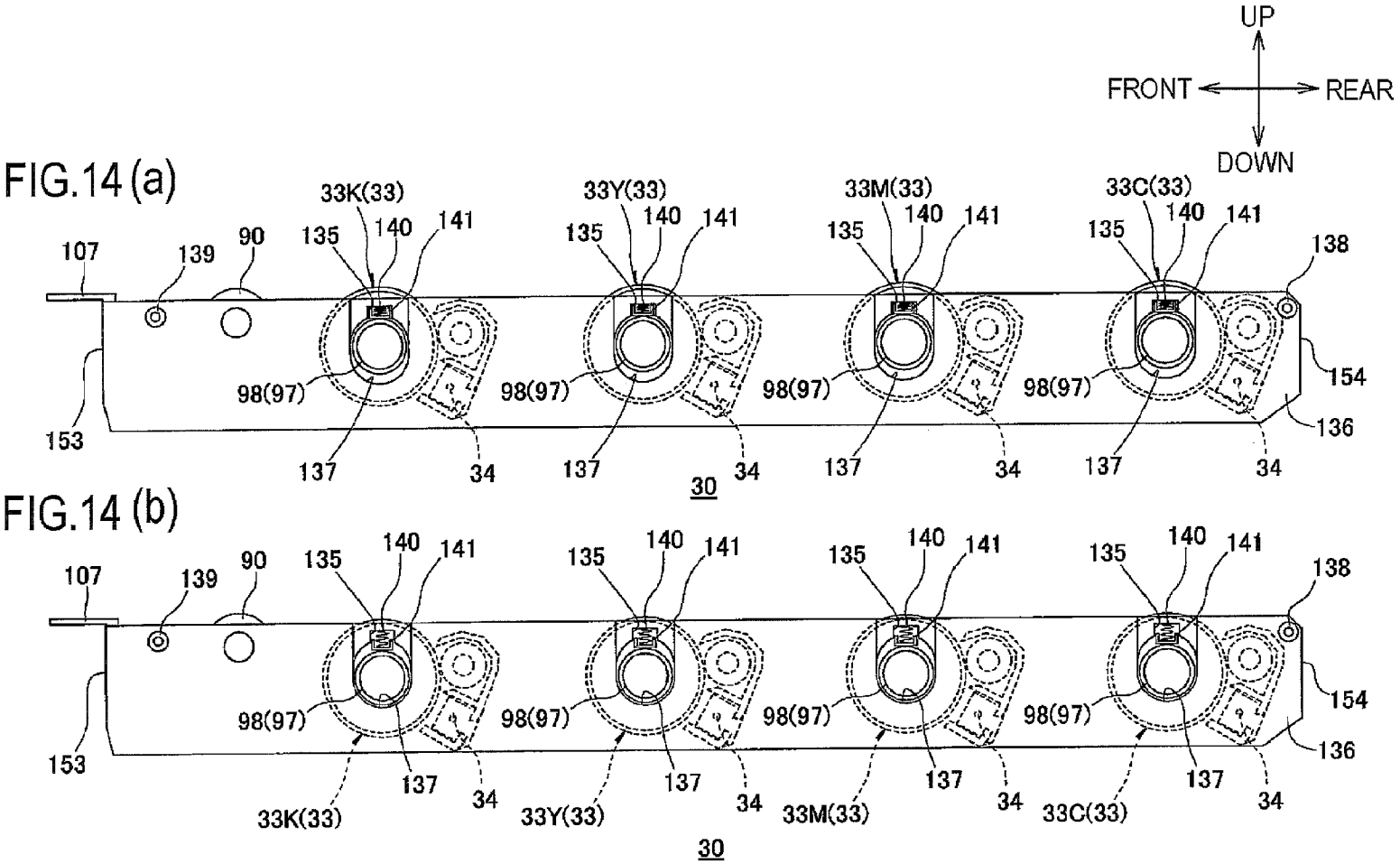
FIGS. 14(*a*) and 14(*b*) are cross-sectional views of a drum unit shown in FIG. 11 and viewed from a right side thereof, wherein FIG. 14(*a*) shows the state where the photosensitive drums advance upward toward a belt unit, and FIG. 14(*b*) shows the state where the photosensitive drums are retracted downward from the belt unit.

In the first embodiment described above, the photosensitive drums 33 are rotatably provided in the drum unit 30 and fixed in position, and the drum unit 30 is fixed in position relative to the belt unit 40. In the second embodiment, as shown in FIGS. 14(*a*) and 14(*b*), the photosensitive drums 33 are provided in the drum unit 30 so as to be both rotatable and movable vertically, thereby positioning the photosensitive drums 33 relative to the belt unit 40.

(1) Overall Structure of the Color Printer According to the Second Embodiment

Figure 11:
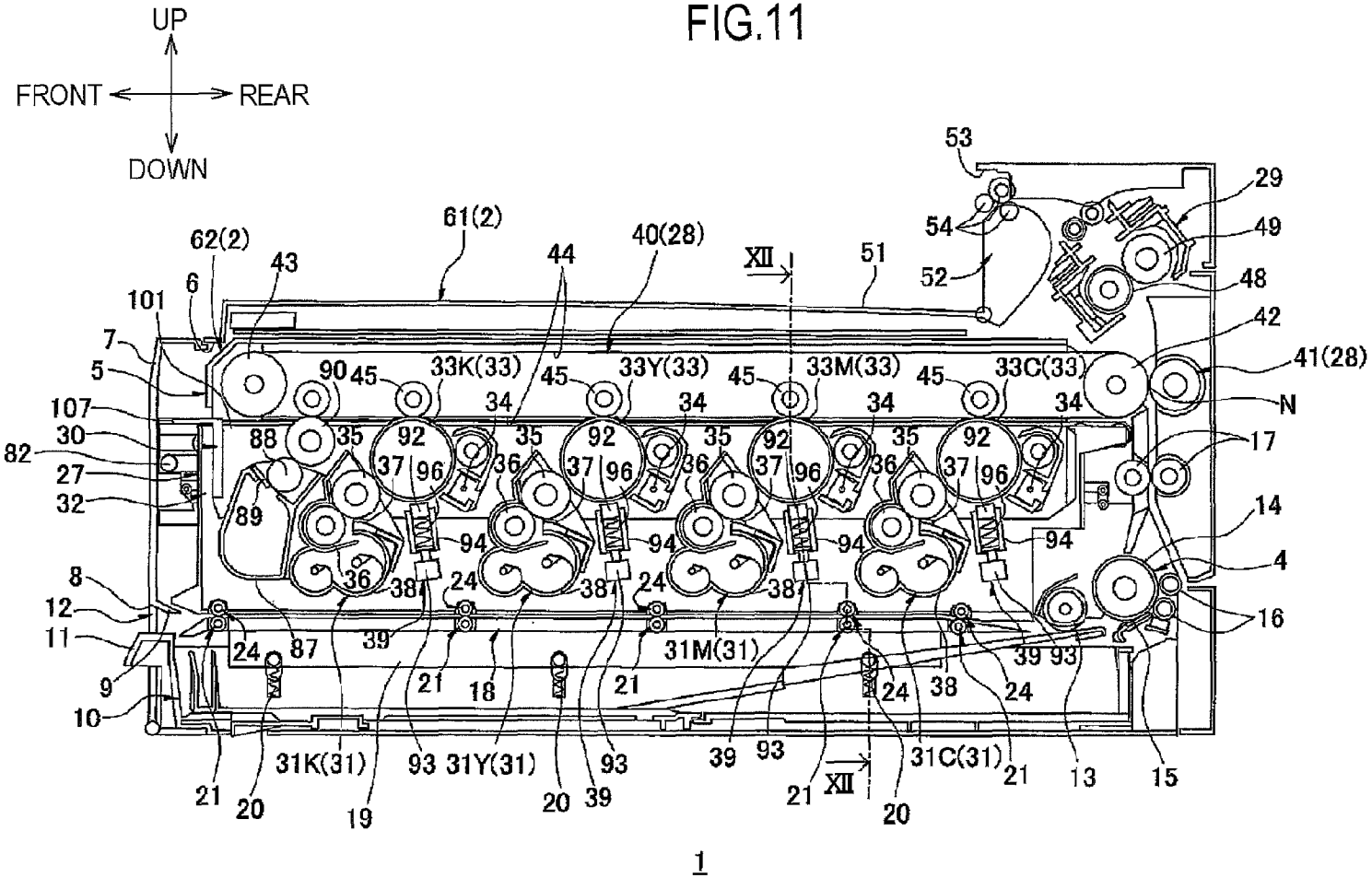
FIG. 11 is a cross-sectional view of a color printer according to a second embodiment.

As shown in FIG. 11, the flatbed scanner 3 and the reference shaft 68 described in the first embodiment (see FIG. 1) are not provided in the second embodiment.

Figure 12:
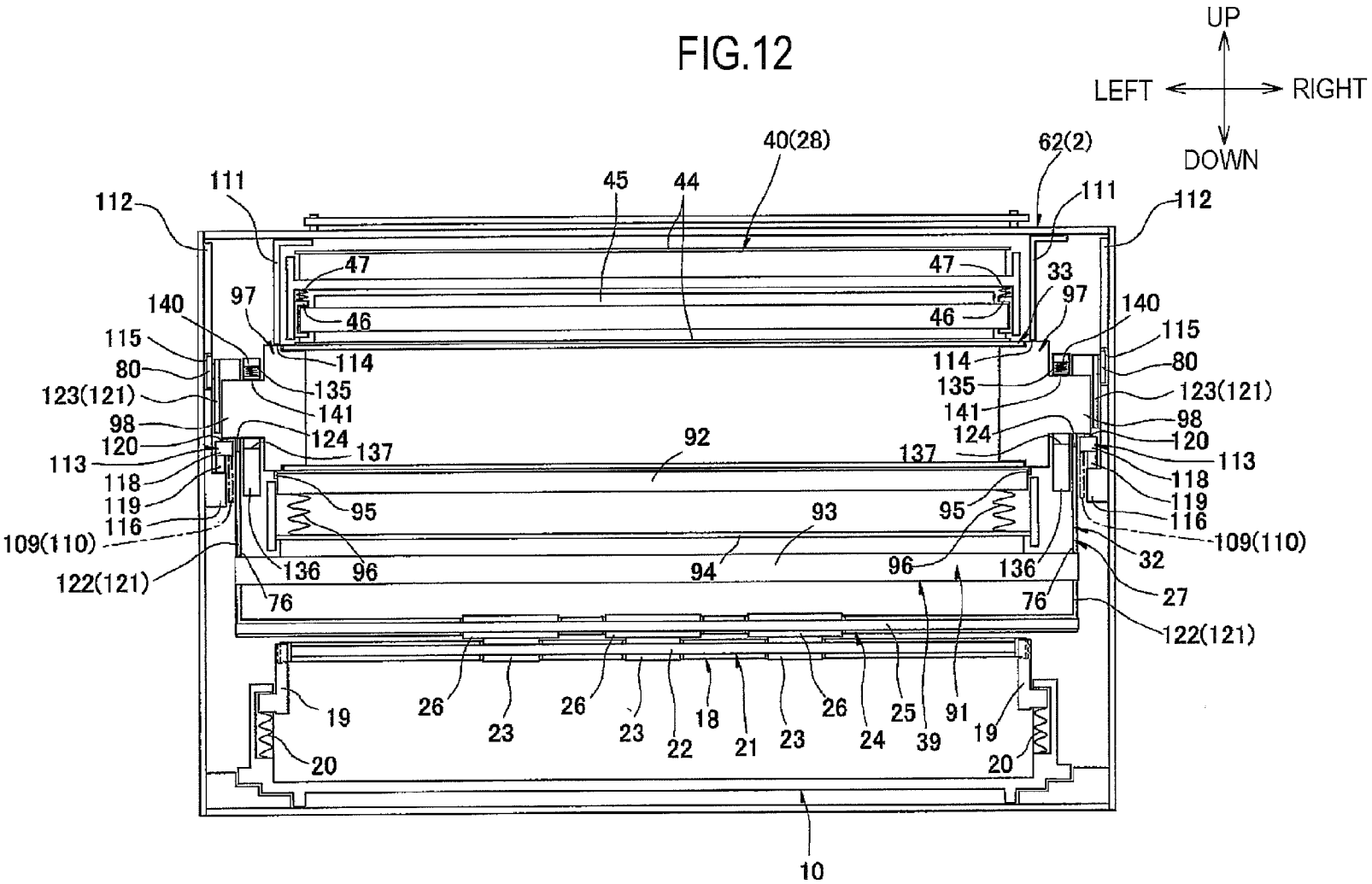
FIG. 12 is a sectional view of the color printer taken along a line XII-XII in FIG. 11.

As shown in FIG. 12, the photosensitive drums 33 in the second embodiment are not provided with the drum shaft 50. Instead, each of the flange members 97 is provided with a protruding part 98 that protrudes outward from the outer surfaces of the flange members 97 in respective left and right directions. The protruding parts 98 share a central axis with the corresponding photosensitive drum 33. The protruding parts 98 are generally cylindrical in shape, with a smaller diameter than that of the flange members 97, and extend in the left-to-right direction.

In the second embodiment, each photosensitive drum 33 and a corresponding Scorotron charger 34 are provided in a frame (not shown) and integrated as a single unit. This unit is integrally supported in the drum unit 30. Thus, four units, in total, are supported in the drum unit 30 for the four colors.

(2) Process Unit (2-1) Process Frame

Figure 13:
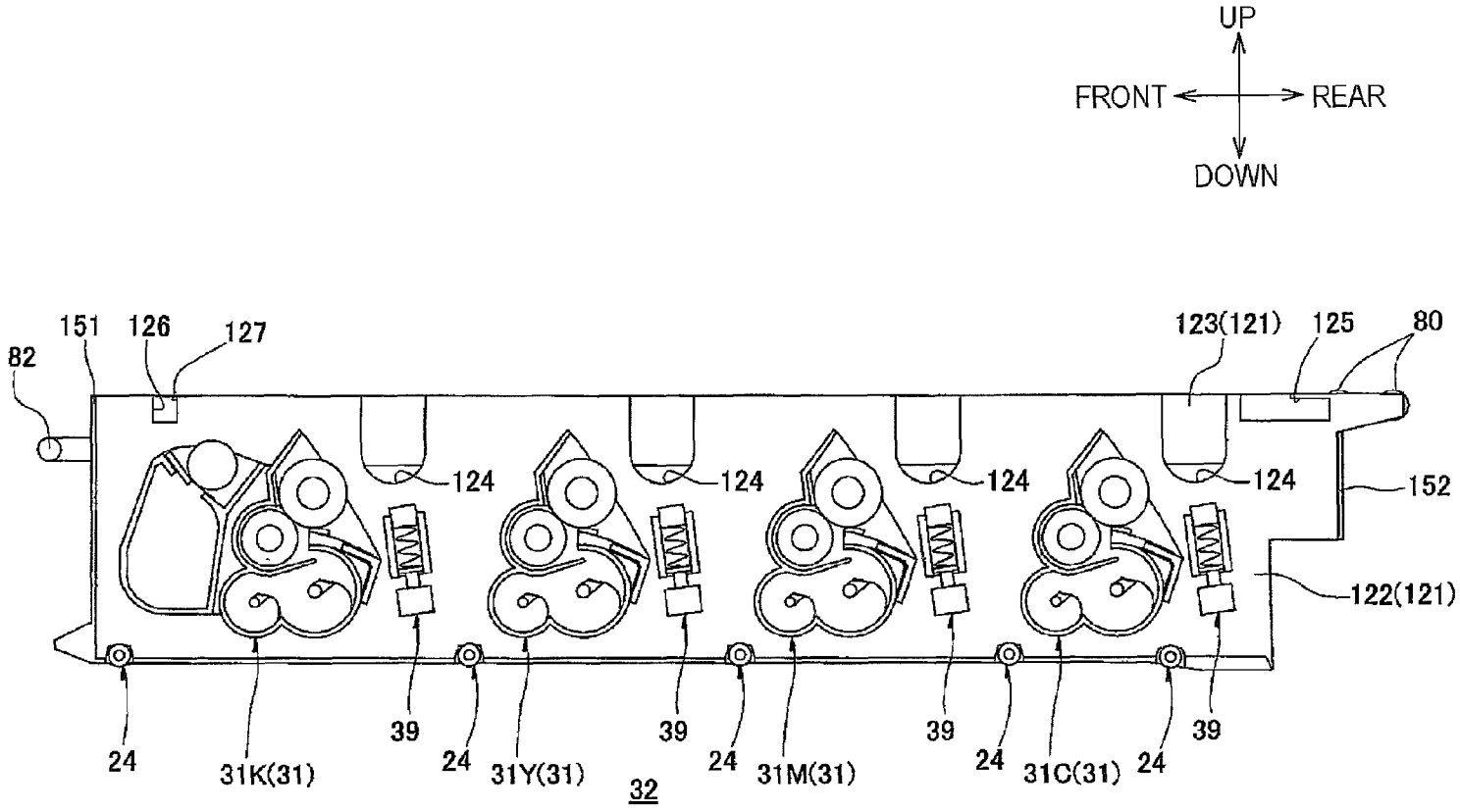
FIG. 13 is a cross-sectional view of a process frame shown in FIG. 11.

As shown in FIGS. 12 and 13, the process frame 32 is a generally rectangular frame-like structure with a closed bottom and an open top. The process frame 32 includes a pair of side walls 121 arranged parallel to each other and spaced apart in the left-to-right direction. The front wall 151 and rear wall 152 span between the pair of side walls 121.

Each side wall 121 is integrally provided with an inner side wall 122 disposed further inward into the process frame 32 with respect to the left-to-right direction, and an outer side wall 123 disposed further outward with respect to the left-to-right direction.

Each of the inner side walls 122 has a flat plate shape that is generally rectangular in a side view and elongated in the front-to-rear direction. Each inner side wall 122 has formed therein four drum guide grooves 124, a rear engaging groove 125, and a front engaging groove 126.

Each of the drum guide grooves 124 is a cutout formed in the top edge of the inner side wall 122 that is recessed downward. The drum guide groove 124 is generally U-shaped in a side view and is open at the top. The drum guide grooves 124 are spaced at intervals in the front-to-rear direction and positioned to correspond to the photosensitive drums 33. The drum guide grooves 124 have a width (front-to-rear dimension) sufficient for receiving the protruding parts 98 of the photosensitive drums 33.

The rear engaging groove 125 is formed in the top edge of each inner side wall 122 near the rear end thereof and farther rearward than the rearmost drum guide grooves 124. The rear engaging grooves 125 are generally rectangular in a side view and elongated in the front-to-rear direction. The top edge of each rear engaging groove 125 is formed so that the front half of the rear engaging groove 125 opens upward. The opening in the top edge has a front-to-rear length sufficient for receiving a rear-side roller 138 (described later) provided on the drum unit 30. The rear engaging grooves 125 have a width (vertical dimension) substantially equal to (slightly larger than) the diameter of the rear-side rollers 138 provided on the drum unit 30.

One of the front engaging grooves 126 is formed in the top edge of each inner side wall 122 near the front side thereof. The front engaging groove 126 is a cutout formed in the top edge of the inner side wall 122 and recessed downward. The front engaging groove 126 has a general U-shape in a side view and is open on the top. The front engaging groove 126 has a width (front-to-rear dimension) substantially equal to (slightly larger than) the diameter of front-side rollers 139 (described later) provided on the drum unit 30. A restricting protrusion 127 is provided on the rear wall defining the front engaging groove 126 and protrudes slightly forward from the top edge of the rear wall into the front engaging groove 126.

The outer side walls 123 have a flat plate shape that is generally rectangular in a side view and elongated in the front-to-rear direction. The outer side walls 123 confront the outside of the corresponding inner side walls 122 at the top edges thereof in left and right directions, respectively. The outer side walls 123 have a vertical dimension smaller than that of the drum guide grooves 124. When projected left-to-right, the top edges of the outer side walls 123 are aligned with the top edges of the inner side walls 122. Consequently, when projected left-to-right, the lower edges of the drum guide grooves 124 are exposed beneath the outer side walls 123.

Figure 17:
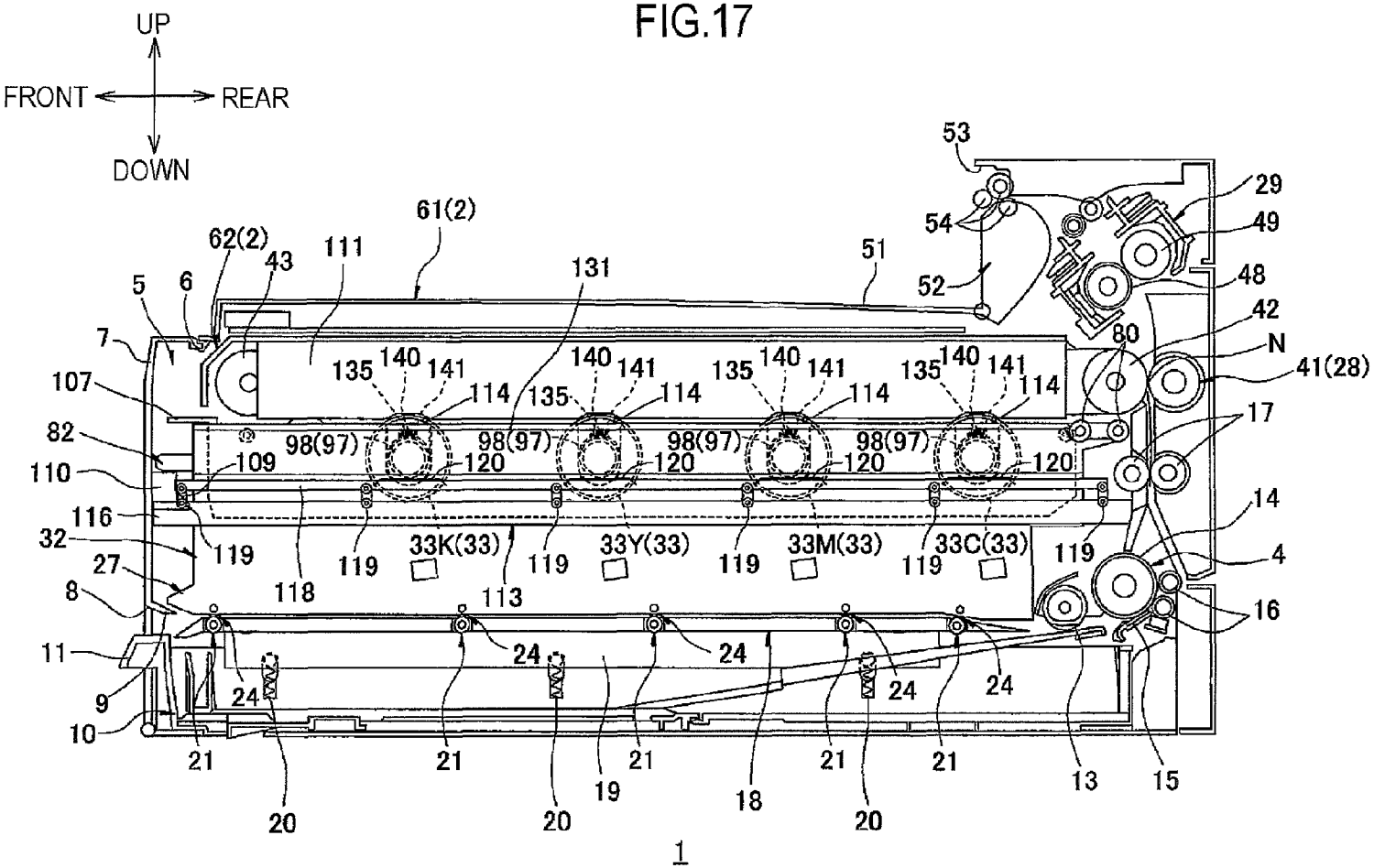

As shown in FIG. 17, a guide rail 131 is provided on each of the outer side walls 123. The guide rail 131 is formed along the top edge of the outer side wall 123 as a substantially linear ridge that extends in the front-to-rear direction and protrudes outward from respective left and right outer surfaces of the outer side walls 123 in respective left and right directions. The pair of front and rear guide rollers 80 is provided on the rear end of each guide rail 131.

(2-2) Drum Unit

As shown in FIGS. 12 and 14, the drum unit 30 has a generally rectangular frame-like structure, open on both the top and bottom. The drum unit 30 includes a pair of side plates 136 disposed parallel to each other and separated in the left-to-right direction. The front plate 153 and rear plate 154 span between the side plates 136.

Each side plate 136 has a flat plate shape and is generally rectangular in a side view. Each side plate 136 has formed therein four flange insertion through-holes 137, and four corresponding compression-spring accommodating parts 135. Each side plate 136 also has a rear-side roller 138 and a front-side roller 139.

The flange insertion through-holes 137 are arranged at intervals in the front-to-rear direction and are positioned to correspond to the photosensitive drums 33. The flange insertion through-holes 137 are through-holes and are elongated vertically. The flange insertion through-holes 137 have a front-to-rear dimension that is substantially equal to (slightly larger than) the outer diameter of the protruding parts 98 provided on the flange members 97 and a vertical dimension greater than the outer diameter of the protruding parts 98. The protruding parts 98 of the flange members 97 are rotatably inserted into the respective flange insertion through-holes 137 and protrude outward therefrom in respective left and right directions.

The compression-spring accommodating parts 135 are cutouts formed in the top edges of the flange insertion through-hole 137 and are substantially rectangular in a side view. The compression-spring accommodating parts 135 are formed continuously with the flange insertion through-holes 137 as an upward recess in the top edges thereof. A compression spring 140 is accommodated in each compression-spring accommodating part 135.

One end of the compression spring 140 is connected to the top wall of the compression-spring accommodating part 135. A sliding member 141 is connected to the other end of the compression spring 140.

The sliding member 141 is generally U-shaped in a side view, with the opening of the U-shape facing upward. The sliding member 141 contacts the top of the protruding part 98 provided on the flange members 97 of the corresponding photosensitive drum 33.

The protruding part 98 of each photosensitive drum 33 is constantly retracted downward by the urging force of the corresponding compression spring 140 and is supported in the lower end of the flange insertion through-hole 137 (see FIG. 14(*b*)). Through this structure, the photosensitive drum 33 is separated from the bottom of the intermediate transfer belt 44 (see FIG. 18).

When pressure is received from the bottom side, the protruding part 98 of the photosensitive drum 33 advances upward against the urging force of the compression spring 140 and is supported in the top end of the flange insertion through-hole 137 (see FIG. 14(*a*)). Through this operation, the photosensitive drum 33 contacts the bottom of the intermediate transfer belt 44 (see FIG. 17).

The rear-side roller 138 is provided in the upper rear corner of each side plate 136. The rear-side roller 138 is generally disc-shaped and has a prescribed thickness in the left-to-right direction. The rear-side roller 138 is rotatably supported on the outer surface of the corresponding side plate 136. Hence, the rear-side roller 138 extends outward in the left or right direction from the side plate 136 a distance equivalent to its thickness.

The front-side roller 139 is provided in the upper front corner of the side plate 136. The front-side roller 139 is generally disc-shaped and has a prescribed thickness in the left-to-right direction. The front-side roller 139 is rotatably supported on the outer surface of the corresponding side plate 136. Hence, the front-side roller 139 extends outward from the corresponding side plate 136 by a distance equivalent to its thickness.

Figure 15:
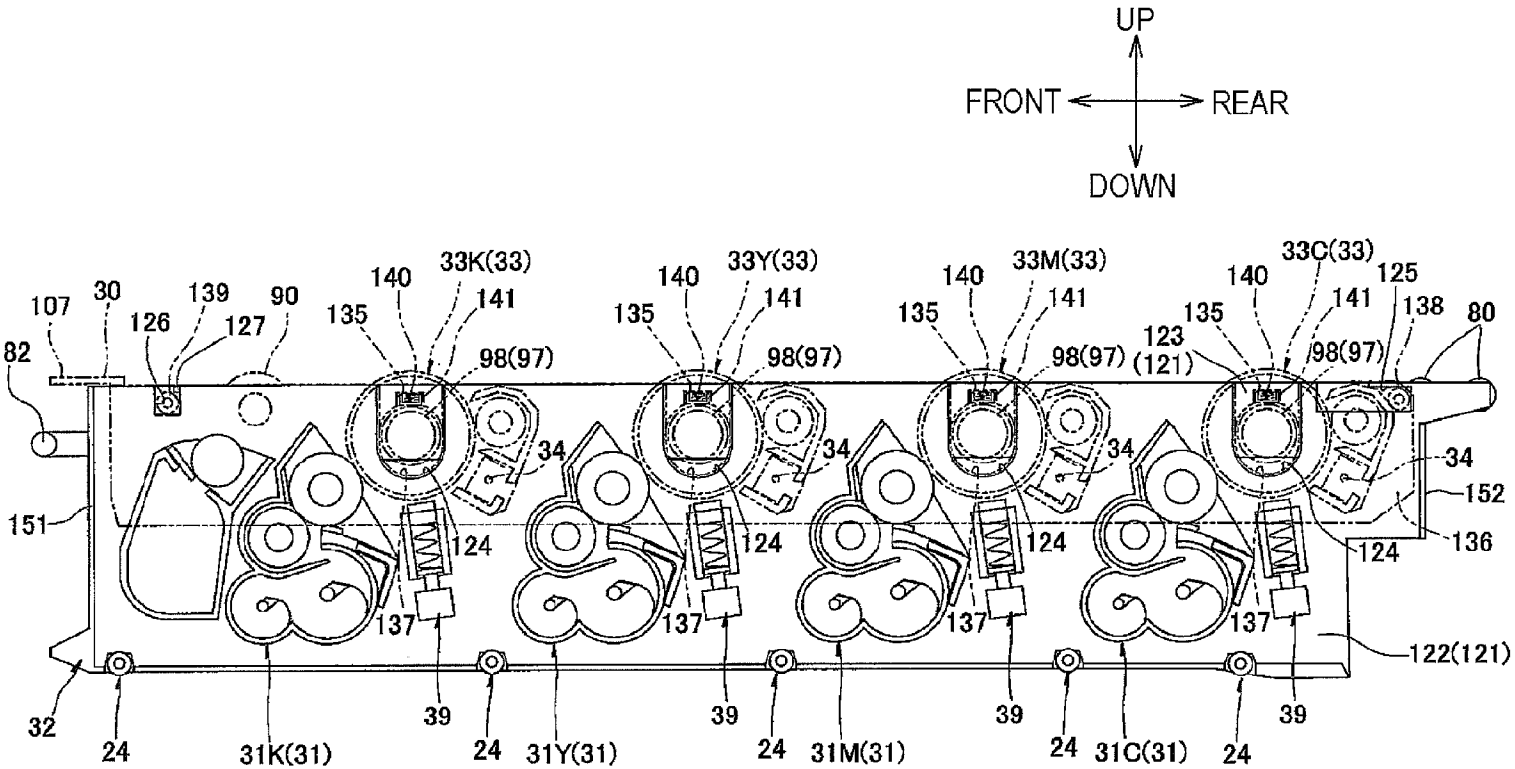
FIG. 15 is a cross-sectional view of a process unit shown in FIG. 11.

As shown in FIG. 15, the drum unit 30 is supported on the top edges of the process frame 32 by fitting the rear-side rollers 138 into the rear ends of the corresponding rear engaging grooves 125 formed in the process frame 32 and by fitting the front-side rollers 139 into the corresponding front engaging grooves 126 of the process frame 32. Through this structure, the drum unit 30 is rotatably supported about the rear-side rollers 138 (see FIG. 20).

At this time, the protruding parts 98 of the flange members 97 on each photosensitive drum 33 are fitted into corresponding drum guide grooves 124 formed in the process frame 32. Specifically, the left and right ends of the protruding parts 98 protrude farther outward in left and right directions than the corresponding inner side walls 122 to oppose the inner left and right surfaces of the corresponding outer side walls 123 (see FIG. 12). Further, when projected in the left-to-right direction from the outer side to the inner side, the bottom portions of the left and right ends of the protruding parts 98 are exposed beneath the corresponding outer side walls 123 (see FIGS. 12 and 15).

(3) Main Casing (3-1) Structure of the Main Casing

As shown in FIGS. 12 and 17, the inner casing 62 of the main casing 2 is provided with a pair of left and right drum-positioning members 111, a pair of left and right guide plates 112, and a pair of left and right pressing mechanisms 113.

The drum-positioning members 111 are arranged in the top end of the inner casing 62, with one on each of the left and right outer sides of the belt unit 40 so as to face each other across a gap in the left-to-right direction. The drum-positioning members 111 are generally plate-shaped and generally rectangular in a side view, extending in the front-to-rear and vertical directions (see FIG. 17). The top ends of the drum-positioning members 111 are fixed to the top wall of the inner casing 62. Four drum-positioning grooves 114 are formed in the bottom edge of each drum-positioning member 111 at positions opposing the photosensitive drums 33.

The drum-positioning grooves 114 are cutouts formed in the bottom edge of each drum-positioning member 111 and are recessed upward. The drum-positioning grooves 114 are generally U-shaped in a side view, with the opening of the U-shape facing downward. The drum-positioning grooves 114 are arranged at intervals along the front-to-rear direction. The drum-positioning grooves 114 have a width (front-to-rear dimension) sufficient for receiving the top ends of the flange members 97 on respective photosensitive drums 33.

The guide plates 112 are fixed to the left and right inner surfaces of the inner casing 62 in the upper half thereof, with their lower edges positioned below the protruding parts 98 of the photosensitive drums 33. The guide plates 112 are formed of a resin material in a general plate shape elongated in the front-to-rear and vertical directions. The guide plates 112 function to guide movement of the process frame 32. Specifically, a guide groove 115 is formed in each guide plate 112 for guiding the process unit 27.

Figure 16:
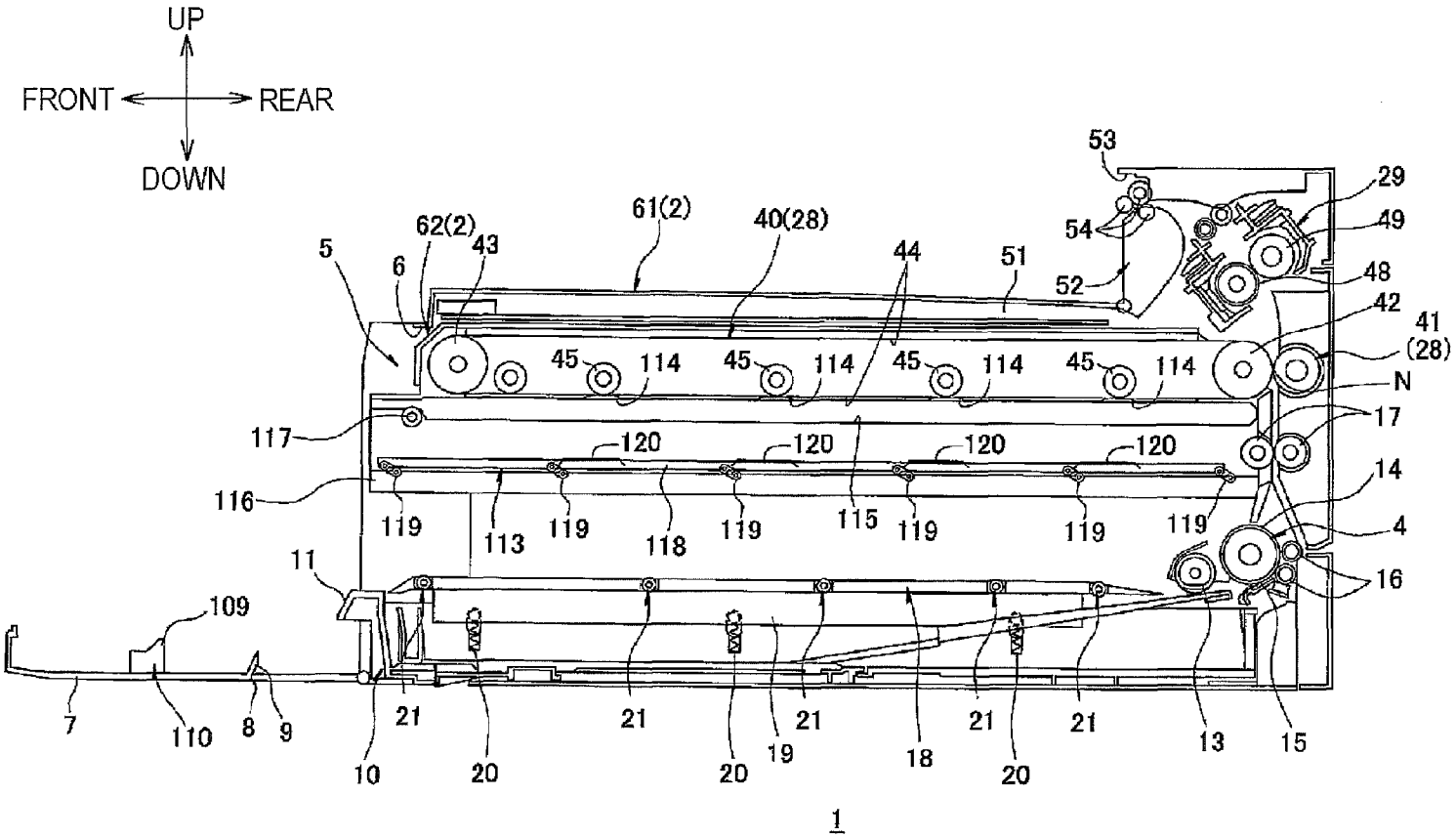
FIG. 16 is a cross-sectional view of a main casing shown in FIG. 11.

As shown in FIGS. 12 and 16, the guide grooves 115 are generally linear grooves formed approximately in the vertical center of the guide plate 112 and extending in the front-to-rear direction. The guide grooves 115 are formed as recesses in the inner surfaces of the left and right guide plates 112 and have a width (vertical dimension) sufficient for receiving the guide rollers 80 of the process frame 32 and a length (front-to-rear dimension) spanning the entire front-to-rear length of the inner casing 62. The width of the guide grooves 115 narrows at the front ends thereof in order to restrict passage of the guide rollers 80 while allowing passage of the guide rails 131.

A main-casing-side roller 117 is provided on each guide plate 112 at the front end of the corresponding guide groove 115 (the region of the guide groove 115 in which the vertical dimension narrows). The main-casing-side rollers 117 are rotatably supported such that their top portions are exposed above the bottom edges of the guide grooves 115.

The pressing mechanisms 113 are parallel linkage mechanisms. One pressing mechanism 113 is provided on each guide plate 112 below the protruding parts 98 of the photosensitive drums 33. Each pressing mechanism 113 includes a fixed linkage member 116, a movable linkage member 118, and six joint members 119.

The fixed linkage member 116 is provided on the lower end of the guide plate 112 and is separated a distance below the protruding parts 98 of the photosensitive drums 33. The fixed linkage member 116 is formed as a ridge on the inner surface of the corresponding guide plate 112 that is generally linear in a side view and extends in the front-to-rear direction. The fixed linkage members 116 protrude inward from the inner surfaces of the guide plates 112.

The movable linkage member 118 is generally rod-shaped and oriented in the front-to-rear direction so as to be parallel to the corresponding fixed linkage member 116. The left-to-right dimension of the movable linkage member 118 is greater than that of the fixed linkage member 116 (i.e., the length in which the members protrude inward in left or right directions). Accordingly, the inner edge of the movable linkage member 118 with respect to the left-to-right direction protrudes farther inward than the inner edge of the corresponding fixed linkage member 116. The movable linkage member 118 is provided with four leaf spring members 120.

The leaf spring members 120 are fixed to the top surface of the movable linkage member 118 and are positioned at intervals in the front-to-rear direction to correspond with the photosensitive drums 33. The leaf spring members 120 are formed of a metal plate elongated in the front-to-rear direction. Both front and rear ends of each leaf spring member 120 is bent downward to form a general trapezoidal shape in a side view in which the upper base is shorter than the lower base. The leaf spring members 120 have an upward elastic force that is greater than the downward elastic force of the compression springs 140.

The joint members 119 are arranged at intervals in the front-to-rear direction. Specifically, one joint member 119 is provided on each of the front and rear ends of the movable linkage member 118 and at positions near the front side of each leaf spring member 120. The joint members 119 have an oblong shape with one end of each joint member 119 rotatably coupled to the lower edge of the movable linkage member 118 and the other end rotatably coupled to the upper edge of the fixed linkage member 116.

With this configuration, the pressing mechanism 113 can be moved between a pressing position (see FIG. 17) in which the joint members 119 are vertically erect and the movable linkage member 118 is advanced upward, and a release position (see FIG. 18) in which the joint members 119 are oriented in the front-to-rear direction (and specifically along a direction sloping from the top front to the bottom rear) and the movable linkage member 118 is retracted downward.

A pair of left and right contact protrusions 110 is provided in the main casing 2 at the approximate vertical center of the front cover 7 for contacting the front ends of the movable linkage members 118. The contact protrusions 110 are plate-shaped and generally rectangular in a side view. The contact protrusions 110 are disposed opposite each other in the left-to-right direction and separated by a prescribed distance. When the front cover 7 is in the closed position, the contact protrusions 110 are inserted between the inner side walls 122 of the process frame 32 and the corresponding fixed linkage members 116. The left-to-right thickness of the contact protrusion 110 is less than the left-to-right gap between the inner side walls 122 of the process frame 32 and the fixed linkage members 116.

Each contact protrusion 110 is provided with a contact part 109. The contact parts 109 are generally trapezoidal in a side view, with an upper base that is shorter than the lower base. When the front cover 7 is disposed in the closed position, the contact parts 109 protrude rearward from the lower ends of the contact protrusions 110, with the rear surface of the contact parts 109 sloping downward toward the rear.

When the front cover 7 is in the open position, the pressing mechanisms 113 are in the release position and the joint members 119 are dropped into a horizontal orientation by the weight of the movable linkage members 118.

When the front cover 7 is moved from the open position to the closed position, the contact parts 109 formed on the contact protrusions 110 of the front cover 7 contact the inside portion on the front ends of the movable linkage members 118 from the lower front side thereof, pushing the movable linkage members 118 obliquely upward and rearward.

The pressure from the contact protrusion 110 forces the joint members 119 into an erect position, and the pressing mechanism 113 is disposed in the pressing position when the front cover 7 arrives in the closed position (see FIG. 17).

(3-2) Positioning the Photosensitive Drums in the Main Casing

When the process unit 27 is in the mounted position and the front cover 7 is in the closed position, the pressing mechanisms 113 are disposed in the pressing position, as shown in FIGS. 12 and 17. In this position, the pressing mechanisms 113 press the protruding parts 98 of the flange members 97 on both ends of each photosensitive drum 33 from below. Specifically, the leaf spring members 120 of the movable linkage members 118 contact the bottoms of the respective protruding parts 98.

From the pressure applied by the movable linkage members 118, the photosensitive drums 33 are lifted upward against the urging force of the compression springs 140. At the same time, the flange members 97 of the photosensitive drums 33 are fitted into the drum-positioning grooves 114 of the drum-positioning members 111 from below, positioning the photosensitive drums 33 relative to the inner casing 62 and relative to the belt unit 40.

At the same time, the guide rollers 80 are fitted into the rear ends of the corresponding guide grooves 115 formed in the inner casing 62. Further, the front ends of the guide rails 131 provided on the process unit 27 confront the tops of the main-casing-side rollers 117 provided in the main casing 2.

(4) Mounting and Removing the Drum Unit with Respect to the Main Casing

Figure 18:
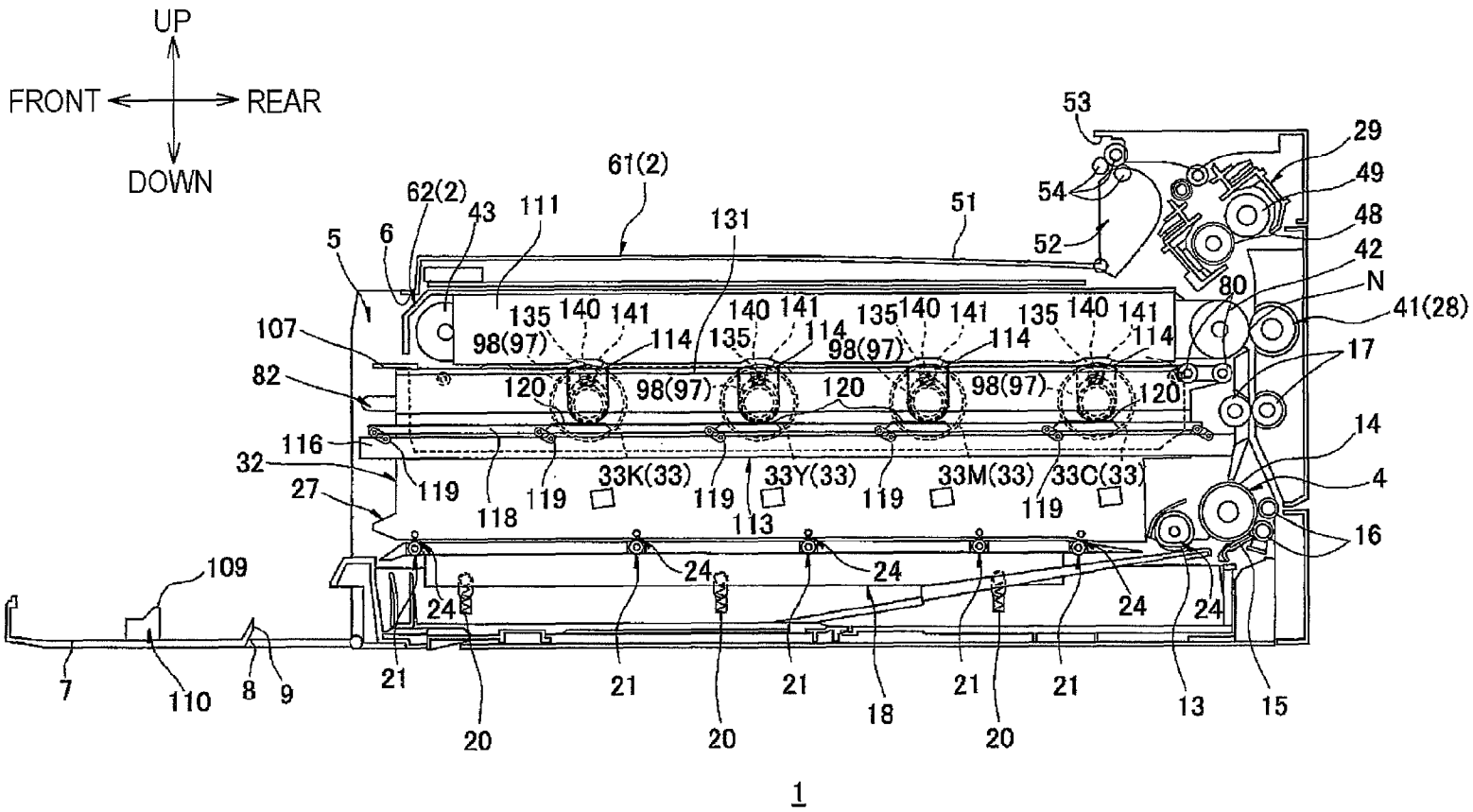

To remove the drum unit 30 from the main casing 2, first the operator rotates the front cover 7 into the open position to expose the access opening 6, as illustrated in FIG. 18. Through this operation, the pressing mechanisms 113 are placed in the release position, moving the photosensitive drums 33 downward and away from the intermediate transfer belt 44.

Next, the operator grips the process-frame-side handle 82 and pulls the process unit 27 forward. Through this operation, the guide rollers 80 on the process frame 32 roll within the guide grooves 115 and the guide rails 131 slide over the main-casing-side rollers 117 as the process unit 27 moves forward.

Figure 19:
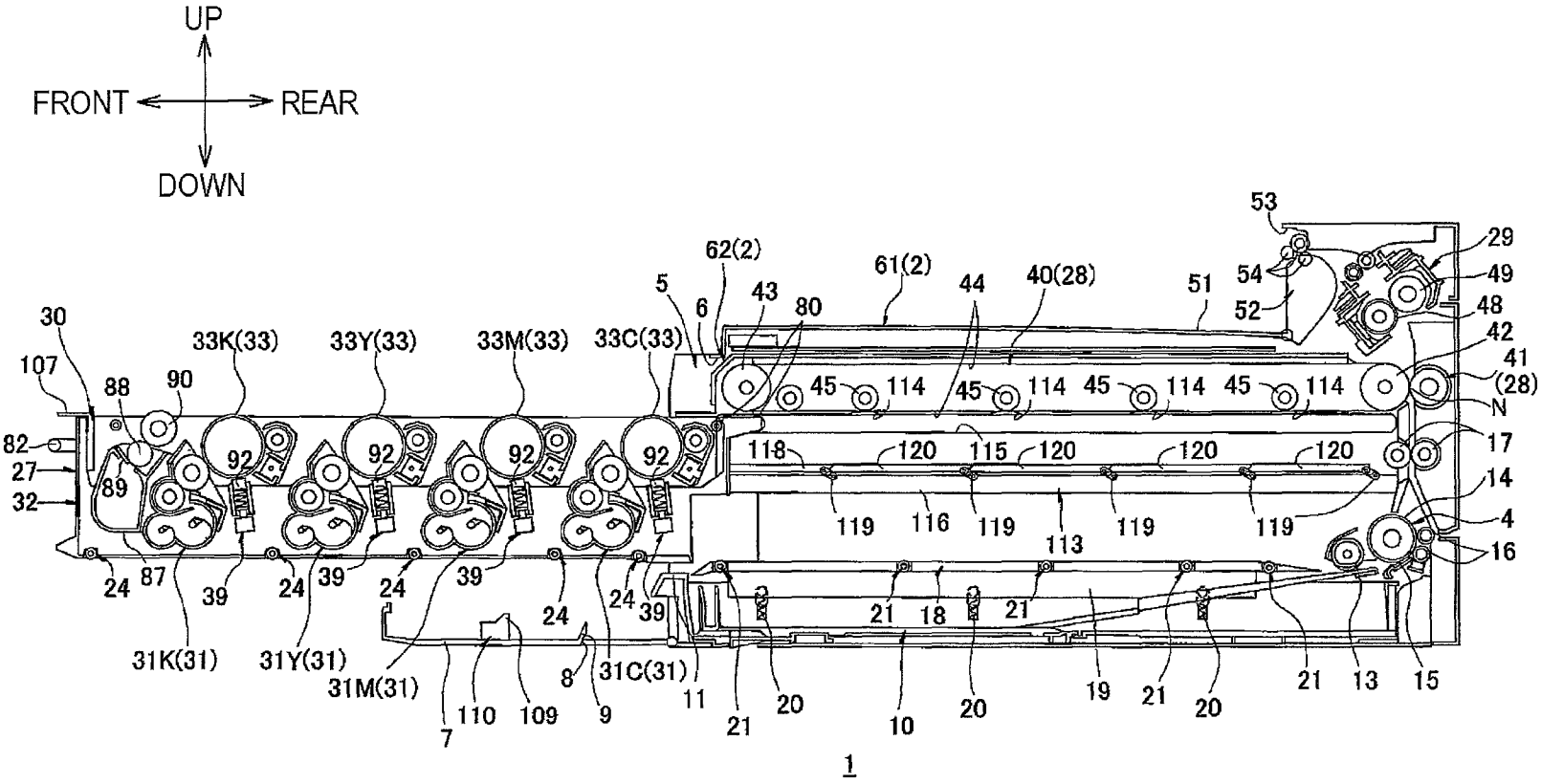

When the guide rollers 80 reach the front end of the guide grooves 115, where the width (vertical dimension) of the guide grooves 115 narrows, as shown in FIG. 19, the process unit 27 is restricted from moving further. At this point, the process unit 27 is in the pulled-out position.

Figure 20:
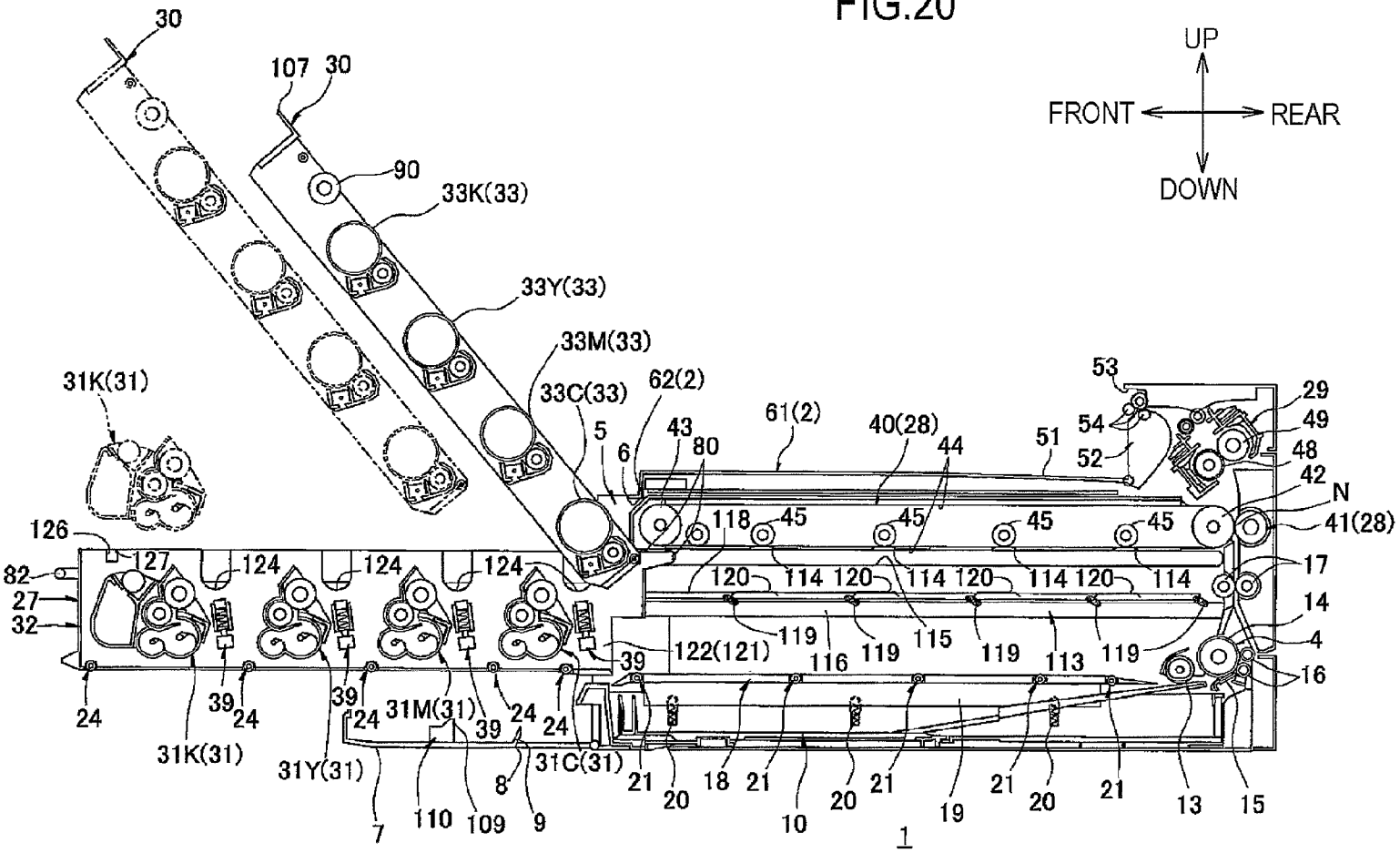
FIG. 20 illustrates how the drum unit and developing cartridges are mounted to and removed from the process unit when the process unit is in the pulled-out position.

In order to remove the drum unit 30 from the main casing 2, the operator grips the drum-unit-side handle 107 on the drum unit 30 while gripping the process-frame-side handle 82 to hold the process frame 32 fixed in the pulled-out position, and lifts the front end of the drum unit 30 upward, as shown in FIG. 20. Through this operation, the front-side rollers 139 on the drum unit 30 rise out of the front engaging grooves 126 formed in the process frame 32, while the drum unit 30 rotates clockwise in a right side view about the rear-side rollers 138.

From this state, the drum unit 30 is pulled forward and then upward to remove the drum unit 30 from the main casing 2. This operation disengages the rear-side rollers 138 from the rear engaging grooves 125 formed in the process frame 32, separating the drum unit 30 from the process frame 32. Note that the developer cartridges 31 remain mounted in the process frame 32 at this time.

In order to mount the drum unit 30 in the main casing 2, the process described above is performed in reverse. That is, first the operator positions the drum unit 30 so that the rear end of the drum unit 30 is above the rear end of the process frame 32. Then the operator inserts the rear end of the drum unit 30 into the rear end of the process frame 32 so that the rear-side rollers 138 become engaged in the front ends of the rear engaging grooves 125.

Next, the operator slides the rear end of the drum unit 30 rearward in order to engage the rear-side rollers 138 in the rear ends of the rear engaging grooves 125. The operator then rotates the drum unit 30 counterclockwise in a right side view about the rear-side rollers 138 until the front-side rollers 139 are fitted into the front engaging grooves 126. At this point, the process for mounting the drum unit 30 in the process frame 32 is completed.

Next, the operator pushes the process unit 27 rearward into the main casing 2. At this time, as shown in FIG. 18, the guide rollers 80 are contacting the rear ends of the guide grooves 115 from the front side thereof, and the process unit 27 is disposed in the mounted position.

Next, the operator rotates the front cover 7 from the open position to the closed position, moving the pressing mechanisms 113 from the release position to the pressing position and fitting the flange members 97 of each photosensitive drum 33 upward into the drum-positioning grooves 114 formed in the drum-positioning members 111, as illustrated in FIG. 17.

Once this operation is performed, the photosensitive drums 33 are positioned relative to the inner casing 62 and are in contact with the bottom surface of the intermediate transfer belt 44. This completes the operation for mounting the drum unit 30 in the main casing 2.

(5) Mounting and Removing the Developer Cartridges Relative to the Process Frame In order to mount the developer cartridges 31 in the process frame 32 or remove the developer cartridges 31 therefrom, just as in the first embodiment described above, the operator first pulls the process unit 27 out of the main casing 2 and rotates the drum unit 30 clockwise in a right side view to expose the top of the process frame 32, as illustrated in FIG. 20.

When removing the developer cartridges 31 from the process frame 32, the operator simply pulls the developer cartridges 31 up and out of the process frame 32. To mount the developer cartridges 31 into the process frame 32, the operator inserts the developer cartridges 31 into the process frame 32 from above.

(6) Operations (6-1) With the color printer 1 according to the second embodiment, the drum unit 30 rotatably and movably supports the photosensitive drums 33, as illustrated in FIGS. 14(*a*) and 14(*b*). The photosensitive drums 33 are moved so as to separate from the belt unit 40 by moving the front cover 7 to the open position in order to pull the process unit 27 out of the main casing 2. The photosensitive drums are placed in contact with the belt unit 40 by mounting the process unit 27 in the main casing 2 and rotating the front cover 7 to the closed position. This construction can prevent the photosensitive drums 33 from rubbing against the belt unit 40 when the process unit 27 is moved.

Since this construction eliminates the need to position the photosensitive drums 33 relative to the drum unit 30, high precision is not necessary when producing the drum unit 30. Accordingly, the drum unit 30 can be formed of a relatively light material, such as a resin material, rather than a highly rigid material, such as a metal, allowing the drum unit 30 to be made lighter.

(6-2) With the color printer 1 according to the second embodiment, the compression springs 140 are provided in the drum unit 30 for each of the photosensitive drums 33 in order to urge the photosensitive drums 33 away from the belt unit 40, as illustrated in FIGS. 14(*a*) and 14(*b*). Since the compression springs 140 constantly urge the photosensitive drums 33 in a direction away from the belt unit 40, this configuration can prevent the photosensitive drums 33 from rubbing against the belt unit 40.

This configuration also prevents the photosensitive drums 33 from inadvertently moving within the drum unit 30 when the drum unit 30 is separated from the color printer 1 as shown in FIG. 20.

As shown in FIG. 17, the main casing 2 is also provided with the pressing mechanisms 113 for pressing the photosensitive drums 33 toward the belt unit 40 against the urging force of the compression springs 140 when the process unit 27 is disposed in the mounted position. Hence, after inserting the process unit 27 into the mounted position, the pressing mechanisms 113 place the photosensitive drums 33 in contact with the belt unit 40 in order that image-forming operations can be performed.

(6-3) As shown in FIG. 17, the color printer 1 according to the second embodiment also includes the movable linkage members 118 elongated in the front-to-rear direction for enabling the pressing mechanisms 113 to press all photosensitive drums 33 integrally. Therefore, the photosensitive drums 33 can be placed in contact with and separated from the belt unit 40 through a simple structure.

(6-4) With the color printer 1 according to the second embodiment, the movable linkage members 118 are provided with the leaf spring members 120 corresponding to each of the photosensitive drums 33 for urging the photosensitive drums 33 toward the belt unit 40, as illustrated in FIG. 17. With this configuration, the photosensitive drums 33 can be pressed reliably against the belt unit 40 with the elastic force of the leaf spring members 120.

(6-5) In the second embodiment, the leaf spring members 120 have a stronger urging force than that of the compression springs 140. Accordingly, the leaf spring members 120 can reliably press the photosensitive drums 33 toward the belt unit 40 against the urging force of the compression springs 140.

(6-6) The color printer 1 according to the second embodiment can obtain the same operational advantages as the color printer 1 in the first embodiment described above.

8. Third Embodiment

Figure 21:
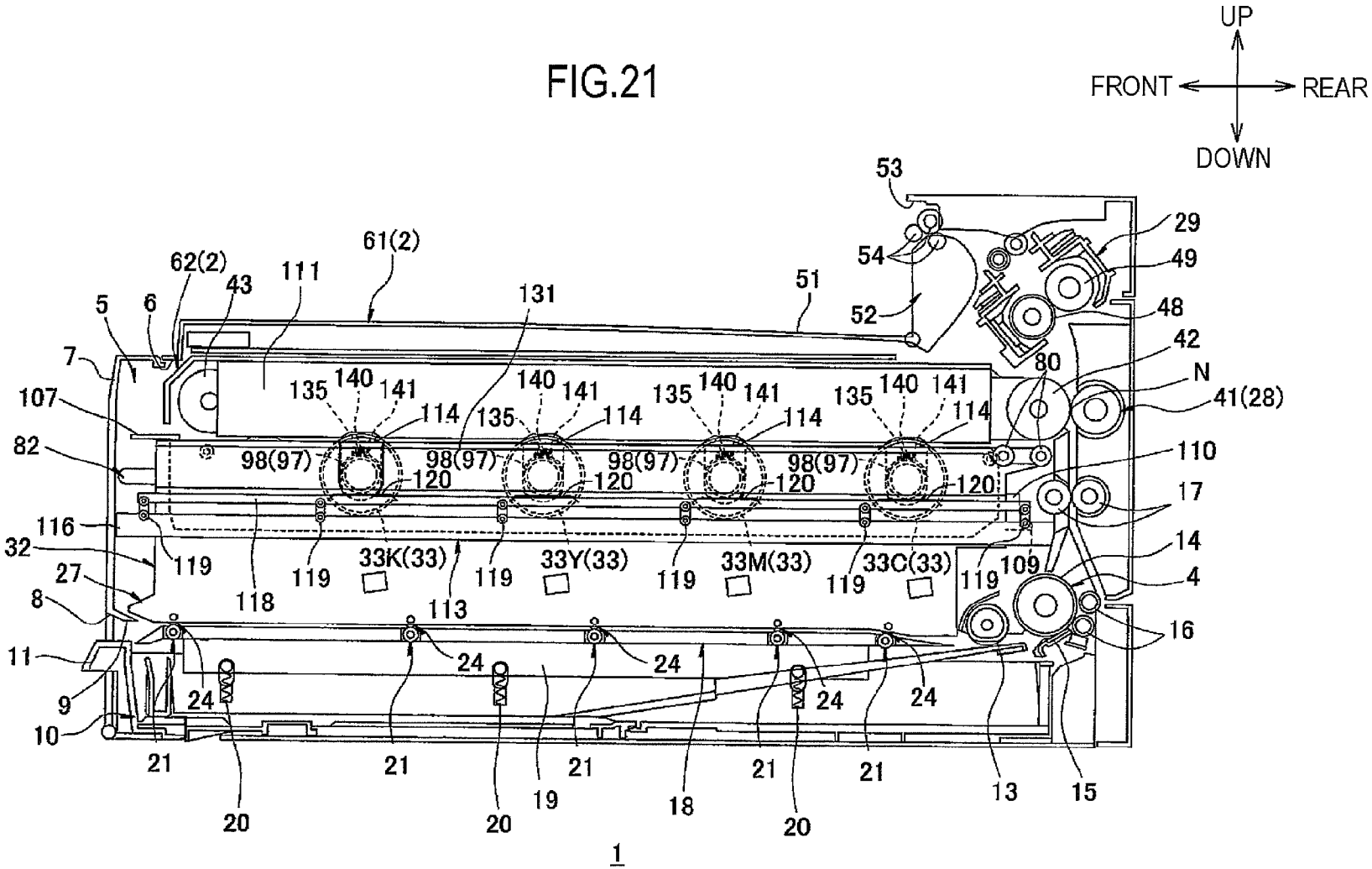
FIG. 21 is a cross-sectional view of a color printer according to a third embodiment.

Next, the color printer 1 according to a third embodiment will be described with reference to FIG. 21, wherein like parts and components are designated with the same reference numerals used in the second embodiment to avoid duplicating description.

In the second embodiment described above, the contact protrusions 110 are provided on the front cover 7 for contacting the movable linkage members 118. However, in the third embodiment shown in FIG. 21, the contact protrusions 110 are provided on the rear end of the process frame 32, with one on each of the left and right sides thereof.

With this construction, the movable linkage members 118 are formed with the same left-to-right dimension as the left-to-right dimension of the fixed linkage members 116 (the length that the members protrude inward in left and right directions). Only the rear ends of the movable linkage members 118 protrude inward farther than the inner ends of the fixed linkage members 116 in order to receive contact by the contact protrusions 110 from the front side thereof.

In the third embodiment, the pressing mechanisms 113 move between the pressing position and the release position in association with the sliding movement of the process unit 27. That is, when the process unit 27 is disposed in the mounted position, the contact protrusions 110 contact the rear ends of the movable linkage members 118, placing the pressing mechanisms 113 in the pressing position.

When the process unit 27 is pulled forward from the mounted position, the contact protrusions 110 move forward and separate from the rear ends of the movable linkage members 118, placing the pressing mechanisms 113 in the release position.

The color printer 1 according to the third embodiment can obtain the same operational advantages as the color printer 1 in the second embodiment described above.

9. Fourth Embodiment

Figures 22A, 22B:
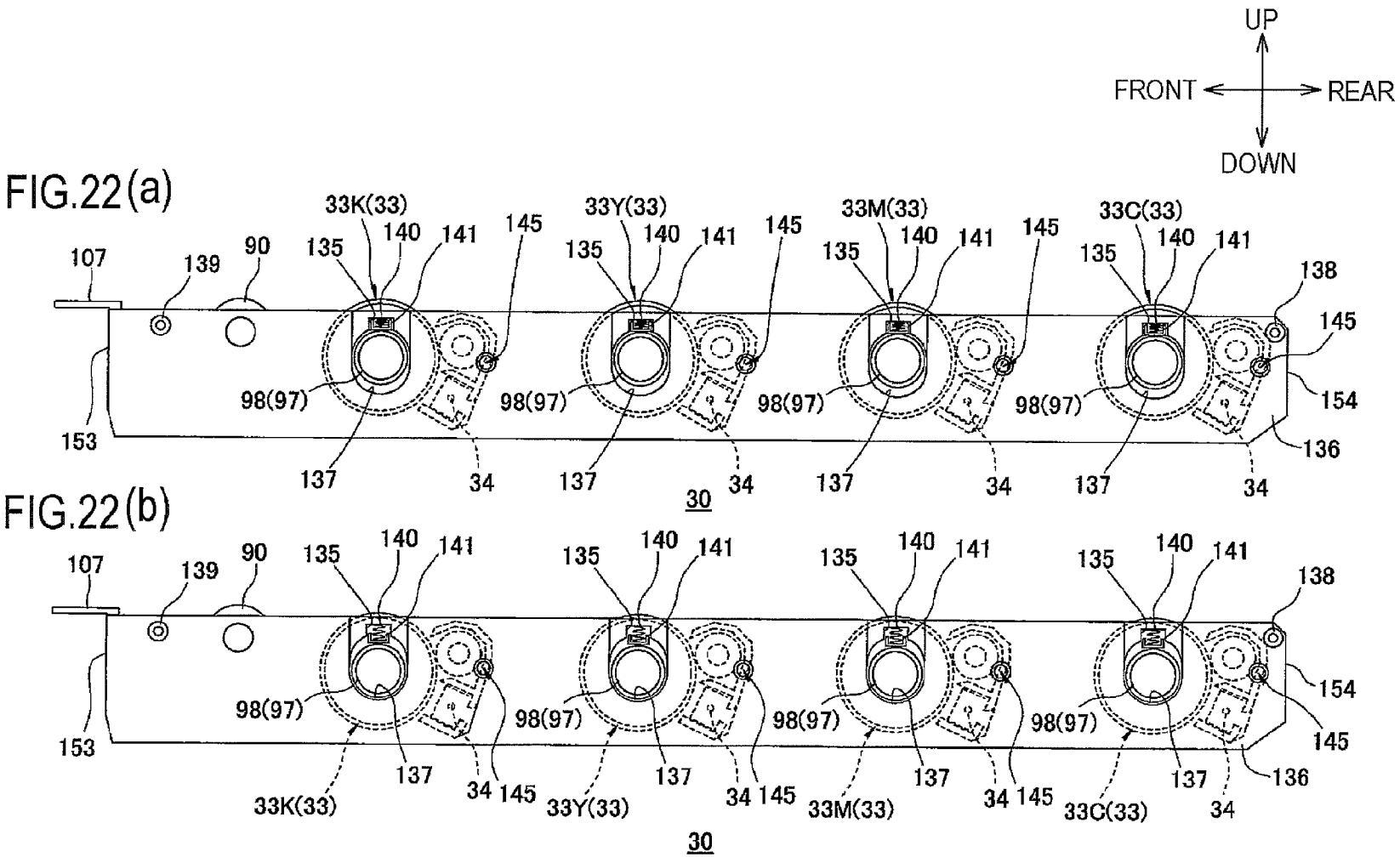
FIGS. 22(*a*) and 22(*b*) are cross-sectional views of a drum unit provided to a color printer according to a fourth embodiment and viewed from a right side thereof, wherein FIG. 22(*a*) shows the state where photosensitive drums advance upward toward a belt unit, and FIG. 22(*b*) shows the state where the photosensitive drums are retracted downward from the belt unit.

Next, the color printer 1 according to a fourth embodiment will be described with reference to FIGS. 22(*a*) and 22(*b*), where like parts and components are designated with the same reference numerals used in the second embodiment to avoid duplicating description.

In the second embodiment described above, the photosensitive drums 33 are provided in the drum unit 30 so as to be capable of sliding vertically. However, in the fourth embodiment shown in FIGS. 22(*a*) and 22(*b*), each frame (not shown) that integrally retains a corresponding photosensitive drum 33 and a corresponding Scorotron charger 34 is provided with a rotational shaft 145. Hence, the photosensitive drum 33 can rotate about the rotational shaft 145.

The color printer 1 according to the fourth embodiment can obtain the same operational advantages as the color printer 1 in the second embodiment described above.

A combination of structures described in the third and fourth embodiments is also possible.

While the invention has been described in detail with reference to the embodiments thereof, it would be apparent to those skilled in the art that various changes and modifications may be made therein without departing from the spirit of the invention.

For example, in the color printers 1 of the above-described embodiments, the drum unit 30 supports four photosensitive drums 33, and the process frame 32 retains four developing cartridges 31 and the drum unit 30. However, the drum unit 30 may support only one photosensitive drum 33, and the process frame 32 may retain only one developing cartridge 31 and the drum unit 30. In this case, the belt unit 40 may be omitted from the color printers 1.

The color printers 1 of the above-described embodiments are of the intermediate transfer type. However, the color printers 1 may be modified into a direct transfer type.

What is claimed is:

1. An image forming apparatus, comprising:

a main body having a positioning member;

a first photosensitive drum detachably mountable to the main body, the first photosensitive drum being disposed below the positioning member when the first photosensitive drum is mounted to the main body;

a transfer belt that is disposed above the first photosensitive drum when the first photosensitive drum is mounted to the main body;

a first urging member configured to urge an end of the first photosensitive drum downward, the end of the first photosensitive drum being defined in an axial direction of the first photosensitive drum; and a second urging member that is configured to urge the first photosensitive drum when the first photosensitive drum is mounted to the main body, the second urging member being configured to urge the first photosensitive drum upward against an urging force of the first urging member, thereby causing the first photosensitive drum to make contact with the positioning member, the first urging member being disposed at a position between the positioning member and the second urging member in the axial direction of the first photosensitive drum.

2. The image forming apparatus as claimed in claim 1, further comprising a side plate configured to rotatably support the end of the first photosensitive drum, the first urging member being provided to the side plate.

3. The image forming apparatus as claimed in claim 2, wherein at least part of the first urging member is disposed between an outer edge and an inner edge of the side plate in the axial direction of the first photosensitive drum.

4. The image forming apparatus as claimed in claim 2, wherein the first photosensitive drum has a flange, the flange having a protruding part that protrudes outward relative to the side plate in the axial direction of the first photosensitive drum.

5. The image forming apparatus as claimed in claim 4, wherein the positioning member is configured to make contact with the flange of the first photosensitive drum.

6. The image forming apparatus as claimed in claim 5, wherein the first urging member and the second urging member are configured to urge the protruding part of the first photosensitive drum.

7. The image forming apparatus as claimed in claim 1, wherein the second urging member includes a leaf spring.

8. The image forming apparatus as claimed in claim 1, wherein the first urging member includes a compression spring.

9. The image forming apparatus as claimed in claim 1, wherein the first photosensitive drum is configured to be detached from the main body in a direction perpendicular to the axial direction of the first photosensitive drum.

10. The image forming apparatus as claimed in claim 1, further comprising:

a second photosensitive drum detachably mountable to the main body, the second photosensitive drum being disposed below the positioning member when the second photosensitive drum is mounted to the main body, the second photosensitive drum being arranged adjacent to the first photosensitive drum in a direction perpendicular to the axial direction of the first photosensitive drum when the first photosensitive drum and the second photosensitive drum are mounted to the main body;

a third urging member configured to urge an end of the second photosensitive drum downward, the end of the second photosensitive drum being defined in an axial direction of the second photosensitive drum; and a fourth urging member that is configured to urge the second photosensitive drum when the second photosensitive drum is mounted to the main body, the fourth urging member being configured to urge the second photosensitive drum upward against an urging force of the third urging member, thereby causing the second photosensitive drum to make contact with the positioning member, the third urging member being disposed at a position between the positioning member and the fourth urging member in the axial direction of the second photosensitive drum.

11. The image forming apparatus as claimed in claim 10, further comprising a side plate configured to rotatably support the end of the first photosensitive drum and the end of the second photosensitive drum, the first urging member and the third urging member being provided to the side plate.

12. The image forming apparatus as claimed in claim 11, wherein at least part of the first urging member and at least part of the third urging member are disposed between an outer edge and an inner edge of the side plate in the axial directions of the first and second photosensitive drums.

13. The image forming apparatus as claimed in claim 11, wherein the second photosensitive drum has a flange, the flange having a protruding part that protrudes outward relative to the side plate in the axial direction of the second photosensitive drum.

14. The image forming apparatus as claimed in claim 13, wherein the positioning member is configured to make contact with the flange of the second photosensitive drum.

15. The image forming apparatus as claimed in claim 14, wherein the third urging member and the fourth urging member are configured to urge the protruding part of the second photosensitive drum.

16. The image forming apparatus as claimed in claim 10, wherein the fourth urging member includes a leaf spring.

17. The image forming apparatus as claimed in claim 10, wherein the third urging member includes a compression spring.

18. The image forming apparatus as claimed in claim 10, wherein the first photosensitive drum and the second photosensitive drum are configured to be detached from the main body in a direction perpendicular to the axial directions of the first and second photosensitive drums.

* * * * *